US005356259A

United States Patent [19]

Hanamoto et al.

[11] Patent Number: 5,356,259

[45] Date of Patent: Oct. 18, 1994

[54] APPARATUS FOR CONTROLLING HYDRAULIC CYLINDERS OF A POWER SHOVEL

[75] Inventors: Tadayuki Hanamoto, Hiratsuka; Shinji Takasugi, Tokyo, both of Japan

[73] Assignee: Kabushiki Kaisha Komatsu Seisakusho, Hiratsuka, Japan

[21] Appl. No.: 956,075

[22] Filed: Oct. 2, 1992

Related U.S. Application Data

[62] Division of Ser. No. 738,592, Jul. 31, 1992, Pat. No. 5,187,510, which is a division of Ser. No. 465,259, Mar. 30, 1990, Pat. No. 5,116,186.

[30] Foreign Application Priority Data

Aug. 2, 1988 [WO] PCT Int'l Appl. ... PCT/JP88/00771

[51] Int. Cl.[5] ..... E02F 9/20

[52] U.S. Cl. ..... 414/694; 414/694; 37/348

[58] Field of Search ..... 414/685, 694, 687, 697, 414/699, 700, 701, 706, 707, 708, 714; 37/DIG. 1

[56] References Cited

U.S. PATENT DOCUMENTS

| | | | |
|---|---|---|---|
| 4,059,196 | 11/1977 | Uchino et al. | 414/699 |
| 4,165,613 | 8/1979 | Bernhoft et al. | 414/699 X |
| 4,288,196 | 9/1981 | Sutton, II | 414/699 |
| 4,332,517 | 6/1982 | Igarashi et al. | 414/699 X |
| 4,377,043 | 3/1983 | Inui et al. | 414/699 X |
| 4,606,313 | 8/1986 | Izumi et al. | 414/699 X |
| 4,744,218 | 5/1988 | Edwards et al. | 414/699 X |
| 4,770,083 | 9/1988 | Johnson | 414/699 X |
| 4,838,756 | 6/1989 | Johnson et al. | 414/699 |

FOREIGN PATENT DOCUMENTS

| | | |
|---|---|---|
| 53-10501 | 1/1978 | Japan . |
| 54-4402 | 1/1979 | Japan . |
| 55-32817 | 3/1980 | Japan . |
| 57-58739 | 4/1982 | Japan . |
| 5968437 | 4/1982 | Japan . |
| 58-80033 | 5/1983 | Japan . |
| 59-14873 | 1/1984 | Japan . |
| 59-150837 | 12/1984 | Japan . |
| 60-55130 | 3/1985 | Japan . |
| 59-220534 | 4/1985 | Japan . |
| 60-37339 | 7/1985 | Japan . |
| 61-9453 | 3/1986 | Japan . |
| 61-64933 | 4/1986 | Japan . |
| 61-14328 | 6/1986 | Japan . |
| 61-225429 | 10/1986 | Japan . |
| 62-160325 | 7/1987 | Japan . |

*Primary Examiner*—Frank E. Werner
*Assistant Examiner*—James T. Eller, Jr.
*Attorney, Agent, or Firm*—Welsh & Katz, Ltd.

[57] ABSTRACT

A technique relating to automatic excavation by a power shovel is shown. An ideal reference locus of movement of a front edge of a bucket is approximated by a plurality of points, positions of the plurality of points and postures of the bucket at these points are previously set. If the start of automatic excavation is assigned by an operation pedal or the like, the position of the front edge of the bucket at the assigned moment is made a position to start excavation. The positions of the plurality of points set relative to a vehicle are calculated for each of excavation sections divided by the plurality of points according to the position to start excavation, and angles of rotation of respective working machines needed to move the front edge of the bucket to the calculated position and to set the bucket to the posture of the bucket set are calculated for each of the excavation sections, and the respective working machines are automatically driven making the calculated angles of rotation target angles of rotation for each excavation section. The bucket, an arm and a boom are thereby automatically controlled so that the front edge of the bucket moves along the ideal reference locus of movement set and the bucket has the ideal posture set by simple operations. Thus, it is intended to improve operation efficiency. After terminating excavation, dropping of load is reduced by automatically driving the bucket so that the bucket is always horizontally maintained in accordance with manual operations of the arm and boom.

14 Claims, 15 Drawing Sheets

MANUAL MOVEMENT TO EXCAVATION START POINT

START OF AUTOMATIC EXCAVATION

AUTOMATIC EXCAVATION

HORIZONTAL HOLDING OF BUCKET

DISCHARGING OF EARTH

AUTOMATIC SETTING OF BUCKET POSTURE

APPARATUS FOR CONTROLLING HYDRAULIC CYLINDERS OF A POWER SHOVEL

This is a division of application Ser. No. 738,592, filed Jul. 31, 1992, now U.S. Pat. No. 5,178,510, which is a divisional of Ser. No. 465,259, filed Mar. 3, 1990, now issued U.S. Pat. No. 5,116,186, issued May 26, 1992.

TECHNICAL FIELD

This invention relates to a technique relating to automatic excavation by a power shovel which has a bucket, an arm and a boom as working machines.

BACKGROUND ART

As is well known, a power shovel has a bucket, an arm and a boom as working machines, which are driven by a bucket cylinder, an arm cylinder and a boom cylinder, respectively. In order to move the bucket in desired locus and posture, it is indispensable to simultaneously control expansion and contraction of the respective cylinders.

Accordingly, in order to move the bucket in desired locus and posture, the operator must simultaneously or alternately operate respective operation levers corresponding to the bucket, arm and boom. Hence, skill is needed for their operation.

An inexperienced operator causes increase in unnecessary resistance against excavation by, for example, not directing the front edge of the bucket in the direction of movement, or by making the base plate of the bucket interfere with an excavated surface after excavation.

On the other hand, there have been proposed various kinds of apparatuses for controlling power shovels in which a moving locus (for example, a straight line, a circular are or the like) of the front edge of the bucket and the posture of the bucket for the locus have previously been set, and the bucket, arm and boom are automatically controlled so that the front edge of the bucket moves along the locus.

However, these conventional automatic excavating apparatuses are in general for finishing operation. Very few apparatuses aim at excavating and loading operations. Furthermore, apparatuses for excavating and loading operations are still incomplete from the viewpoint of operation efficiency, operation capability, time required for excavation, and the like. Hence, the relating technique is still immature for being used in an actual apparatus.

Furthermore, in conventional apparatuses, the speed of working machines at the moment of an automatic mode is fixed. No apparatuses have existed in which the speeds of working machines can be arbitrarily changed by a simple operation.

Moreover, in conventional apparatuses, the locus of excavation is fixed. Hence, there is a problem in that, even when a bucket hits hard earth and sand, an obstacle and the like in the course of excavation, the bucket intends to move along an excavation locus which has previously been set, and as a result, relief loss occurs, and efficiency is therefore reduced.

In addition, conventional apparatuses are more or less unsatisfactory from the viewpoint of efficient utilization of pump output. That is, in conventional apparatuses, commands for flow rates for respective working machines are obtained by obtaining the distribution ratio of the flow rate of a pump for respective working machines according to angles of rotation needed for respective working machines, and by distributing the flow rate of the pump determined from actual pump pressure in the distribution ratio. In general, oil supplied from a pump tends to flow toward a working machine having small load. In conventional apparatuses, the values of commands for flow rates calculated from the above-described distribution ratio are input to respective working machines without modification. Hence, oil flows to a working machine having small load in the amount which is more than the amount corresponding to the command for the flow rate, and oil flows to a working machine having large load in the amount which is less than the amount corresponding to the command for the flow rate. As a result, oil is not exactly distributed in accordance with the distribution ratio. Actual flow rates of oil for respective working machines are determined according to relative movement between a pump and valves for working machines, and oil does not flow exactly in the amount corresponding to the values of commands for respective working machines. Hence, the actual values of flow rates become smaller than the sum of the values of commands for flow rates for respective working machines. As a result, relief loss and loss in pump energy are produced, and time for excavation therefore increases.

The present invention has been made in consideration of such circumstances.

It is an object of the present invention to provide a method and an apparatus for controlling the hydraulic cylinders of a power shovel in which the working machines are automatically controlled so as to perform the most suitable operation for excavation by a simple operation, and efficiency for excavating and loading operation can be improved.

It is a further object of the present invention to provide a method and an apparatus for controlling hydraulic cylinders of a power shovel in which automatic excavation can be performed in the most suitable posture and locus of a working machine by a simple operation of an operation pedal, operation efficiency is therefore improved, and the speeds of working machines can be arbitrarily changed in accordance with the tread angle of the operation pedal.

It is a still further object of the present invention to reduce relief loss by correcting a locus which has been set in accordance with actual load, and to enable to perform excavation of an always constant amount of earth even when the locus has been corrected.

It is still another object of the present invention to provide an apparatus for controlling working machines of a power shovel in which excavation efficiency is improved by driving the working machines effectively utilizing pump output.

DISCLOSURE OF THE INVENTION

According to one aspect of the present invention, there are provided automatic mode assigning means for assigning an automatic mode, an automatic mode start detection means for detecting a moment to start excavation by the automatic mode, angle detection means for detecting an angle of a bucket, an angle of an arm and a angle of a boom, first arithmetic means for taking in values detected by the angle detection means at the moment to start excavation according to an output from the automatic mode start detection means and for obtaining the position of a front edge of the bucket relative to a vehicle according to the detected values, second arithmetic means for previously setting a reference locus of movement of the front edge of the bucket approximated by a plurality of points and respective postures of the bucket when the front edge of the bucket is situated at the plurality of points, for calculating a position relative to the vehicle for each of the plurality of points which have been set position by position for each excavation sections divided by the plurality of points according to the positions to start excavation obtained by the first arithmetic means and for calculating an angle of rotation of the bucket, an angle of rotation of the arm and an angle of rotation of the boom needed to move the front edge of the bucket to the calculated position and to set the bucket to the posture of the bucket which has been set for each proper point for each of the excavation sections, third arithmetic means for obtaining a distribution ratio of flow rates of pressurized oil to be supplied to respective working machines for each of the excavation sections according to the angle of rotation of the bucket, the angle of rotation of the arm and the angle of rotation of the boom calculated for each of the excavation sections and for calculating and outputting commands for flow rates for the respective working machines according to a flow rate of a pump obtained from the pump pressure detected by the pressure detection means and the distribution ratio obtained, excavation section end detection means for detecting a moment when the angle of the arm reaches a target arm for each of the excavation sections according to an output from the angle detection means and for moving the arithmetic control by the second and third arithmetic means from arithmetic control for a proper excavation section to the arithmetic control for the next excavation section at the moment of the detection, switching means for outputting respective commands for flow rates output from the third arithmetic means in place of manual commands giving priority to manual commands when the automatic mode has been assigned by the automatic mode assigning means, and automatic excavation end detection means for detecting the end of automatic excavation by the automatic mode.

According to such a configuration of the present invention, if the automatic mode is selected by the automatic mode assigning means after the front edge of the bucket has been moved to the position to start excavation by a manual operation, the start of excavation is detected by the automatic mode start detection means. Subsequently, the bucket, arm and boom are automatically controlled so that the front edge of the bucket moves along the reference locus of movement which has been set and the bucket has the posture set at the plurality of points on the reference locus of movement. That is, the position to start excavation is obtained from the value detected by the angle detection means at the moment to start excavation, and a coordinate of the next target position along the locus of movement which has been set relative to the vehicle is obtained from the position to start excavation. The angle of rotation of the bucket, the angle of rotation of the arm and the angle of rotation of the boom needed to set the bucket to the posture set at the next target position and to move the front edge of the bucket from the position to start excavation to the next target position are obtained. The distribution ratio of flow rates of pressurized oil to be supplied to respective working machines is further obtained from these angles of rotation which have been obtained. The value of the flow rate of the pump for the working machines is then obtained from a predetermined relationship which has previously been set between the pump pressure and the flow rate of the pump and actual pump pressure, commands for flow rates for the respective working machines is calculated by distributing ratio, and the commands for flow rates are output to the respective working machines. The control for each excavation section is terminated when the angle of the arm reaches the target arm, and the control moves to the next excavation section. Such control is repeated until the end of automatic excavation is detected. Priority is always given to manual operation during automatic excavation.

Hence, according to the present invention, completely automatic excavation control along a locus of excavation for excellent operation efficiency becomes possible by a simple operation of automatic mode assigning means, such as an operation pedal, an operation button or the like. Furthermore, since the control of working machines is performed so that resistance against excavation is small, no dropping of load occurs and the output of a pump is effectively utilized at the moment of excavation, it is possible to intend improvement in operation efficiency and shortage of time for excavation.

According to another aspect of the present invention, a reference locus of movement of a front edge of a bucket approximated by a plurality of points and respective postures of the bucket when the front edge of the bucket is situated at these plural points have previously been set, and there are provided an operation pedal for assigning the selection of an automatic mode and a moment to start excavation, tread angle detection means for detecting a tread angle of the operation pedal, angle detection means for detecting an angle of the bucket, an angle of an arm and an angle of a boom, first arithmetic means for taking in values detected by the angle detection means at the moment when the operation pedal has been trodden, for obtaining a position of the front edge of the bucket relative to a vehicle according to the detected values, for calculating positions of the plurality of points set relative to the vehicle according to the obtained position to start excavation for the front edge of the bucket, and for calculating an angle of rotation of the bucket, an angle of rotation of the arm and an angle of rotation of the boom for each of the excavation sections needed to move the front edge of the bucket to the calculated position and to set the bucket to the posture of the bucket set for each proper point, second arithmetic means for obtaining a distribution ratio for flow rates of pressurized oil to be supplied to respective working machines according to the calculated angle of rotation of the bucket, angle of rotation of the arm and angle of rotation of the boom, and for calculating commands for flow rates for the respective working machines by distributing the total flow rate of the pressurized oil to be supplied to the working machines in the distribution ratio obtained, third arithmetic means for varying the sum of the commands for flow rates for the respective working machines calculated by the second arithmetic means in accordance with a value detected by the tread angle detection means while maintaining the distribution ratio, and a driving system for driving the bucket, arm and boom according to the commands for flow rates output from the third arithmetic means.

In such a configuration, the tread angle of the operation pedal detected by the tread angle detection means is input to the third arithmetic means. The third arithmetic means drives the respective working machines with speeds in accordance with the tread angle of the pedal by varying the sum of the commands for flow rates for the respective working machines calculated by the second arithmetic means in accordance with the detected value of the tread angle which has been input while maintaining the distribution ratio and by outputting the varied commands for flow rates to the driving system.

The operation pedal is provided with the function to forcibly stop automatic excavation, and excavation is forcibly stopped when the tread angle of the operation pedal exceeds a predetermined angle.

It is also possible to provide the operation pedal with the function to store and instruct the angle of the boom and the angle of the arm. When the bucket was rotated by a predetermined amount or more toward the side of discharged earth at the moment of a horizontal mode for the bucket for horizontally holding the bucket after the end of automatic excavation, if the operation pedal has been trodden by a predetermined angle or more, the angle of the arm and the angle of the boom at this moment is stored. At the next or later horizontal mode for the bucket, the boom and arm are automatically moved to positions corresponding to the stored angle of the boom and angle of the arm in a state in which the bucket is horizontally held when the operation pedal has been trodden.

Thus, according to the present invention, since it is arranged so that the speeds of the working machines are varied in accordance with the tread angle of the operation pedal, the operator can drive the working machines at desired speeds at the moment of automatic excavation. Furthermore, since it is arranged so that automatic excavation can be forcibly terminated by strongly treading the operation pedal at the moment of automatic excavation, the operator can stop automatic excavation at an early stage when, for example, the bucket sufficiently scoops earth and sand. Thus, it is possible to prevent wasteful excavation. Moreover, since it is arranged so that the position to discharge earth is stored by strongly treading the operation pedal at the moment of discharging earth and the working machines are automatically moved to the stored position to discharge earth at the next and later excavation operations, it is possible to discharge earth always at an identical position.

According to another aspect of the present invention, in a configuration in which a reference locus of movement of a front edge of a bucket approximated by a plurality of points and respective postures of the bucket when the front edge of the bucket is situated at the plurality of points are previously set, and the bucket, an arm and a boom are automatically rotated in units of respective excavation sections divided by the plurality of points so that the front edge of the bucket moves along the plurality of points from an assigned position to start excavation and the bucket has the postures set at the plurality of points, there are provided load detection means for detecting load, first means for upwardly driving the boom until a detected value reaches a second set value which is smaller than a first set value when the value detected by the load detection means becomes the first set value or more during automatic excavation and for resuming automatic excavation for remaining sections making the position of the front edge of the bucket upwardly driven a point to resume excavation, and second means for adding excavation volume from the start of excavation to a predetermined section and excavation volume of remaining sections when automatic excavation has ended up to the predetermined section after the automatic excavation resumed, for subtracting the added value from excavation volume by the reference locus of movement when the boom is not upwardly driven and for supplementing a section for performing linear excavation for the volume corresponding to the subtracted value before the remaining sections.

According to such a configuration, the first set value is set, for example, to a value which is a little smaller than relief pressure. Hence, when the load of the working machines becomes large, the boom rises before oil is relieved, and the load is therefore reduced. The rise of the boom stops at the moment when the load is reduced to the second set value, and automatic excavation for remaining sections is then resumed making that position a point to resume excavation. Subsequently, when automatic excavation has ended up to a predetermined section, such as an intermediate point or the like, a section for linear excavation is supplemented by the second means.

Thus, according to the present invention, since it is arranged so that the locus which has been set is corrected in accordance with the actual load, relief loss is favorably reduced. Furthermore, since it is arranged so that a section for horizontal excavation having a length in accordance with actual excavated volume is provided, it is possible to make the amount of excavated earth always uniform even when the locus is corrected.

According to another aspect of the present invention, there are provided pump pressure detection means for detecting the pump pressure of a pump for working machines, first control means for taking in detected values of an angle of a bucket, an angle of an arm and an angle of a boom at an assigned moment to start excavation, for obtaining a position of the front edge of the bucket relative to a vehicle according to the detected values, for calculating positions of a plurality of points which have been set relative to the vehicle according to the obtained position to start excavation for the front edge of the bucket, for obtaining an angle of rotation of the bucket, an angle of rotation of the arm and an angle of rotation of the boom needed to move the front edge of the bucket at the calculated position and to set the bucket to the postures of the bucket set for a proper point for each of excavation sections and for obtaining a distribution ratio of flow rates of pressurized oil to be supplied to respective working machines according to the angles of rotation for each of the excavation sections, and second control means for setting a relationship between the pump pressure for obtaining predetermined horsepower and the flow rate of the pump, for obtaining commands for flow rates for the respective working machines by distributing the flow rate of the pump calculated from the relationship set and the pump pressure detected by the pump pressure detection means in the distribution ratio obtained, for outputting a command which is larger than the obtained command for the flow rate for a working machine having the largest load and for outputting the obtained commands for the flow rates for other two working machines, and a driving system for driving the bucket, arm and boom according to the commands for flow rates output from the second control means.

By outputting a command having a value which is larger than the command for a flow rate calculated from the distribution ratio and the relationship between the pump pressure and the flow rate of the pump for a working machine having the largest load (usually the arm) by the second arithmetic means, and by outputting commands having values which are identical to the calculated values of commands for flow rates for other two working machines, the sum of the values of commands for flow rates is made a value which is larger than the flow rate of the pump determined by the pump pressure. As a result, oil flows to the respective working machines in flow rates exactly in the calculated distribution ratio, and relief loss and loss in the output of the pump are reduced. It is thereby possible to effectively utilize the output of the pump, and to increase excavation efficiency.

BEST MODE FOR CARRYING OUT THE INVENTION

The present invention will now be explained in detail with reference to the embodiments shown in the accompanying drawings.

First, a first embodiment of the present invention will be explained with reference to FIGS. 1–14.

Figure 2:
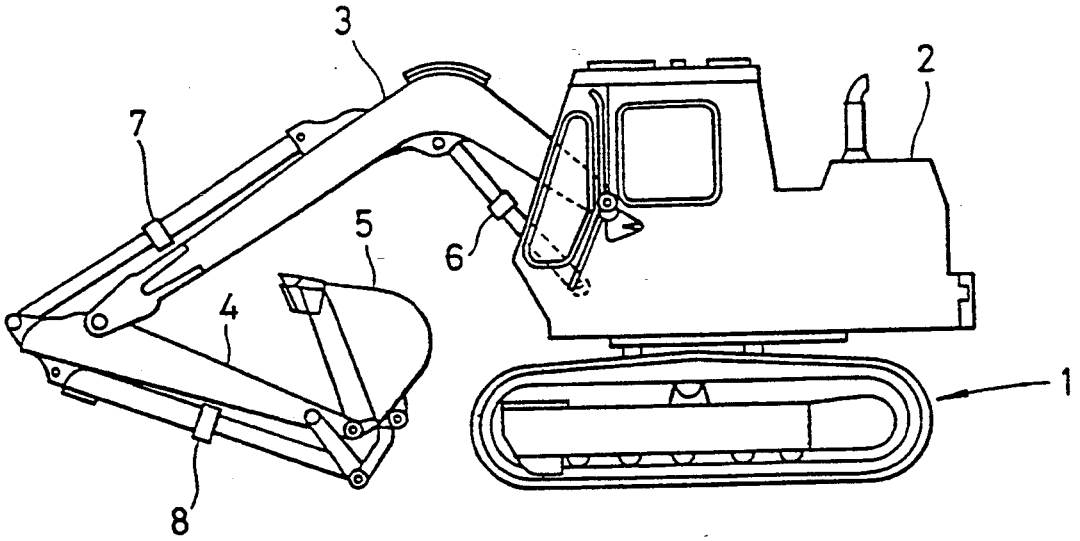
FIG. 2 is a diagram showing an appearance of a power shovel.

FIG. 2 shows the schematic configuration of a power shovel. In FIG. 2, an upper pivoting body 2 is pivotably supported on a running body 1. One end of a boom 3 is pivoted on the pivoting body 2. An arm 4 is pivoted on another end of the boom 3. A bucket 5 is pivoted on another end of the arm 4. The boom 3, the arm 4 and the bucket 5 are rotatably driven by a boom cylinder 6, an arm cylinder 7 and a bucket cylinder 8, respectively.

Figure 3:
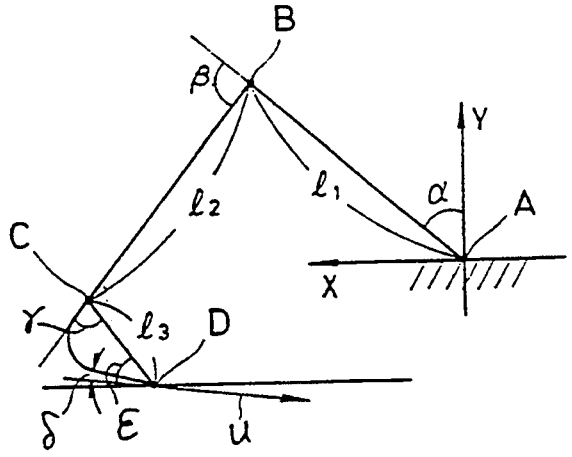
FIG. 3 is a diagram used for defining the lengths, angles and the like of working machines.

The lengths, angles and the like of the respective working machines are now defined as indicated in FIG. 3. That is, the points of rotation for the boom, arm and bucket and the point of the front-edge of the bucket are represented by points A, B, C and D, respectively, and $l_1$: the length between the points A and B $l_2$: the length between the points B and C $l_3$: the length between the points C and D $\alpha$: the angle made by a line segment AB and the vertical axis (the angle of the boom)

$\beta$: the angle made by a line segment BC and the production of the line segment AB (the angle of the arm)

$\gamma$: the angle made by a line segment CD and the production of the line segment BC (the angle of the bucket)

$\delta$: the angle made by a direction u of excavation and the base plate of the bucket (the angle of excavation)

$\epsilon$: the angle made by the direction u of excavation and the line segment CD.

The posture of the bucket is defined by the angle and the like.

Figure 4:
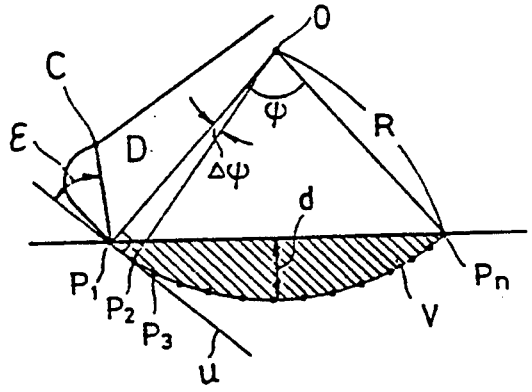
FIG. 4 is a diagram for explaining a method of setting a locus of automatic excavation.

First, the method of setting a locus of excavation at the moment of automatic excavation will be explained. In the present embodiment, a locus of excavation for the front edge of the bucket as shown in FIG. 4 is set. This locus is a locus of a circular arc having a radius R centering around a predetermined point O, and the circular-arc locus is approximated by n points $P_1$, $P_2$,- - - $P_n$. In setting the locus, it is assumed that the amount V of earth in one excavation operation (a hatched region in FIG. 4) is obtained by multiplying the full amount of the bucket by a predetermined number k (=1–3), the depth d of excavation is obtained by multiplying the length of the line segment CD (=$l_3$) by a predetermined number e (=0.1–1.5), and an angle $\psi$ is a proper value between 10°–180°. The values k, e, $\psi$ and the radius R of the circular arc are determined in accordance with the quality of earth, the form of the bucket, the contents of operation and the like, and a reference locus of excavation is determined by specifying these values. For the locus of excavation thus determined, the n points $P_1-P_n$ are approximated as described above, and these points $P_1-P_n$ are made target positions for the front edge of the bucket for respective unit excavation sections. The positions of the points $P_2-P_n$ are set making the position of the point $P_1$ to start excavation a reference position. The postures of the bucket, that is, the above-described angles $\epsilon_1-\epsilon_n$ are previously determined for the target positions $P_1-P_n$, respectively.

In determining the posture $\epsilon$ of the bucket, resistance against excavation is minimized by providing a small excavation angle $\delta$ at the moment to start excavation and by providing a small excavation angle $\delta$ within a range in which the back portion of the bucket interferes with earth as little as possible during excavation. That is, in this excavation operation, a virtual line OD is rotated by a unit angle $\Delta\psi(=\psi/n)$ so that the bucket follows the target positions $P_1-P_n$ with the postures $\epsilon_1-\epsilon_n$ by simultaneously driving the boom, arm and bucket.

Figure 5:
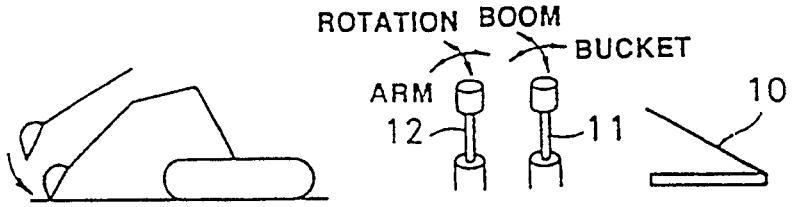
FIGS. 5(*a*)–5(*f*) consist of process diagrams for explaining processes of automatic excavation.
Figure 5:
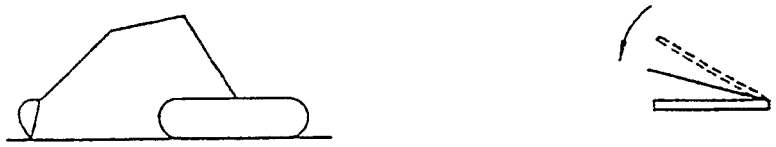
Figure 5:
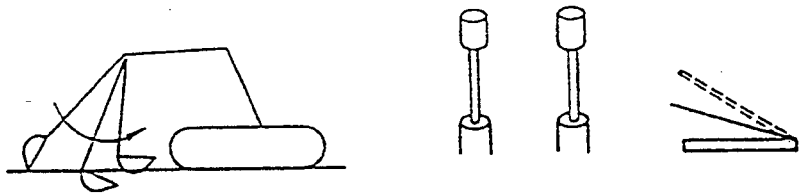
Figure 5:
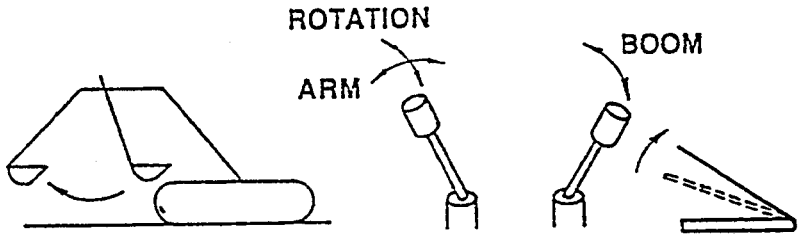
Figure 5:
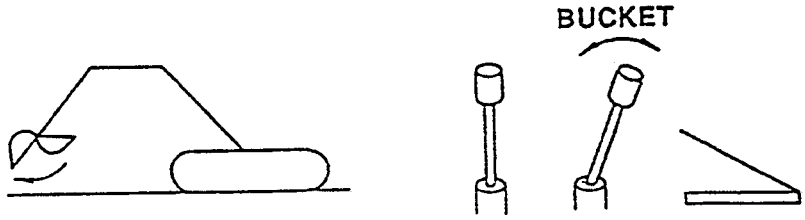
Figure 5:
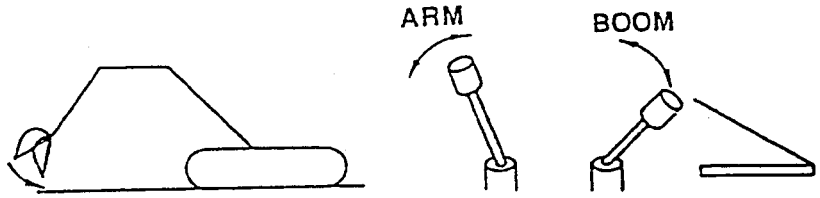

Automatic excavation in the present embodiment is executed in accordance with the processes shown in FIG. 5. The outline of the processes will now be explained. In the present apparatus, there is provided an operation pedal 10 for instructing an automatic excavation mode in addition to two operation levers 11 and 12 for providing commands for rotation and pivoting motion for the boom, arm and bucket. Automatic excavation along the above-described circular-arc locus is preformed by the operation of the operation pedal 10 (by continuing to tread the pedal).

First, the operator moves the front edge of the bucket to a desired position to start excavation by operating the operation pedals 11 and 12 (FIG. 5(*a*)), and then selects the automatic excavation mode and assigns the position to start excavation by treading the operation pedal 10 (FIG. 5(*b*)). That is, when the operation pedal 10 has been trodden, the position of the front edge of the bucket at that moment is obtained, and the obtained position is made the position to start excavation for the present excavation operation.

If the position $P_1$ to start excavation for the point A of rotation for the boom is expressed by a coordinate $(X_1, Y_1)$, the position $(X_1, Y_1)$ can be obtained by the following expression using the angle $\alpha$ of the boom, the angle $\beta$ of the arm and the angle $\gamma$ of the bucket at the moment when the pedal has been trodden:

$$\begin{aligned} X_1 &= l_1\cos\alpha_1 + l_2\cos(\alpha_1+\beta_1) + l_3\cos(\alpha_1+\beta_1+\gamma_1) \\ Y_1 &= l_1\sin\alpha_1 + l_2\sin(\alpha_1+\beta_1) + l_3\sin(\alpha_1+\beta_1+\gamma_1). \end{aligned} \quad (1)$$

Figure 6:
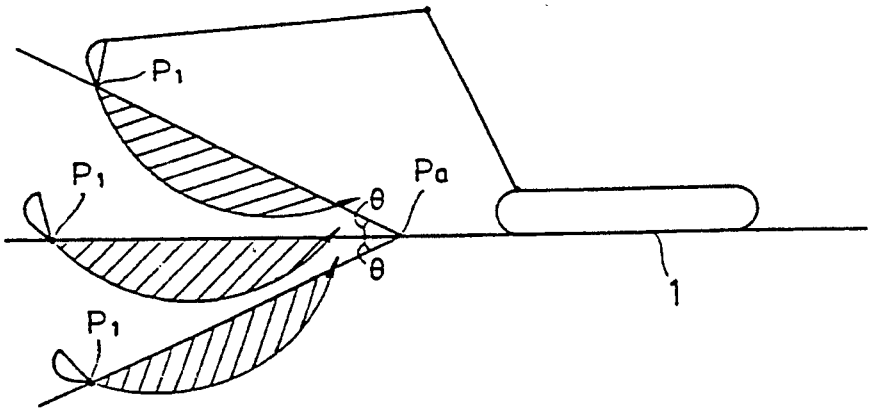
FIG. 6 is a diagram showing rotating states of a locus of excavation.

In the present embodiment, as shown in FIG. 6, a tilt angle $\theta$ of topography is estimated from the position relationship between the detached position $P_1$ to start excavation and a predetermined point $P_a$ which has previously been set, the above-described circular-arc locus is rotated in accordance with the tilt angle $\theta$, and automatic excavation in accordance with the rotated circular-arc locus is performed. The predetermined point $P_n$ is set to a proper position in front of the running body 1. It becomes thereby possible to more or less deal with variations in topography.

That is, in the present automatic excavation operation, an arithmetic algorithm has previously been set so that the most suitable excavation locus and posture of the bucket at the present excavation operation are determined if the operator assigns only the position to start excavation. In the present embodiment, all positions of the plural points $P_1-P_n$ which have been set relative to the vehicle (the point A of rotation of the boom) are not obtained at the moment to start excavation, but the next target position is obtained each time at each unit section. The storage capacity is thus reduced.

When the start of excavation has been assigned, the coordinate for the next target position $P_2$ which advances by the unit angle $\Delta\phi$ on the excavation locus determined in accordance with the position to start excavation is obtained. Furthermore, since the posture of the bucket has been determined in accordance with the target position $P_2$. it is possible to uniquely determine the angle $\alpha_2$ of the boom. the angle $\beta_2$ of the arm and the angle $\gamma_2$ of the bucket at the target position $P_2$. If the target angles $\alpha_2$, $\beta_2$ and $\gamma_2$ of the working machines have been determined. It is possible to determine target angles $\Delta\alpha$, $\Delta\beta$ and $\Delta\gamma$ of rotation for the respective working machines in order to move the front edge of the bucket up to the point $P_2$ by obtaining deviations from the actual angles of the respective working machines.

Figure 7:
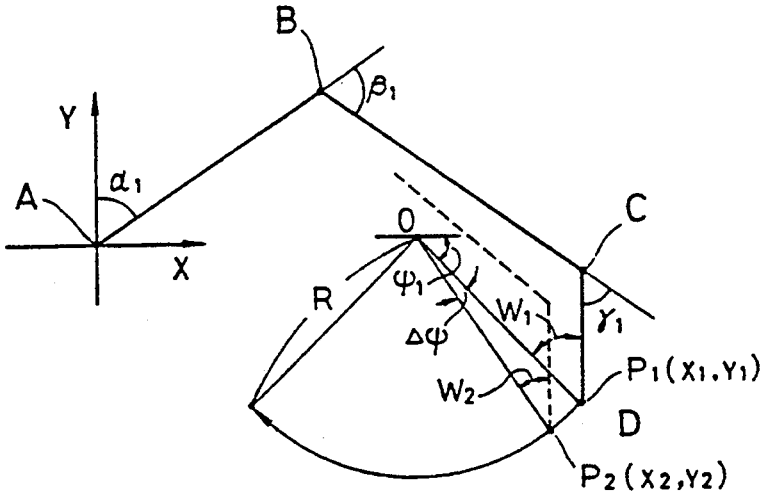
FIG. 7 is a diagram for explaining a method for obtaining $\Delta\alpha$, $\Delta\beta$ and $\Delta\gamma$.

FIG. 7 is a diagram for explaining the calculation to obtain $\Delta\alpha$, $\Delta\beta$ and $\Delta\gamma$, where the symbol $\phi$, represents the angle made by the horizontal line and the line segment OD, the symbol $w_1$ represents the angle made by the line segment CD and the line segment OD at the point $P_1$ to start excavation, and the symbol $w_2$ represents the angle made by the line segment CD and the line segment OD at the next target position $P_2$.

If the coordinate for the point $P_2$ is expressed by $(X_2, Y_2)$, we obtain $$\begin{aligned} X_2 &= l_1\cos(\alpha_1+\Delta\alpha) + l_2\cos(\alpha_1+\beta_1+\Delta\alpha+\Delta\beta) + l_3\cos(\alpha_1+\beta_1+\gamma_1+\Delta\alpha+\Delta\beta+\Delta\gamma) \quad (2) \\ &= X_1 + Y_1\cdot\Delta\alpha + \{l_2\cdot\cos(\alpha_1+\beta_1) + l_3\cdot\cos(\alpha_1+\beta_1+\gamma_1)\}\cdot\Delta\beta + l_3\cos(\alpha_1+\beta_1+\gamma_1)\Delta\gamma. \end{aligned}$$

It is also possible to express $X_2$ by $$X_2 = X_1 + R\cdot\Delta\phi\cdot\sin(\phi_1+0.5\,\Delta\phi) \quad (3).$$

If the terms in the expression (2) are expressed by $l_2\cos(\alpha_1+\beta_1)+l_3\cos(\alpha_1+\beta_1+\gamma_1)+l_a$ and $l_3\cos(\alpha_1+\beta_1+\gamma_1)\cdot\Delta\gamma=l_b$, the following expression holds from the expressions (2) and (3):

$$Y_1\cdot\Delta\alpha + l_a\Delta\beta + l_b\Delta\gamma = -R\cdot\Delta\phi\sin(\phi_1+0.5\Delta\phi) \quad (4).$$

Similarly, the following expression holds:

$$\begin{aligned} Y_2 &= Y_1 + X_1\Delta\alpha - \{l_2\sin(\alpha_1+\beta_1) + l_3\sin(\alpha_1+\beta_1+\gamma_1)\}\Delta\beta - l_3\sin(\alpha_1+\beta_1+\gamma_1)\Delta\gamma \quad (5) \\ &= Y_1 - R\cdot\Delta\phi\cdot\cos(\phi_1+0.5\Delta\phi). \quad (6) \end{aligned}$$

If the terms in the expression (5) are expressed by $l_2\sin(\alpha_1+\beta_1)+l_3\sin(\alpha_1+\beta_1+\gamma_1)=l_c$ and $l_3\sin(\alpha_1+\beta_1+\gamma_1)\Delta\gamma=l_d$, the following expression holds from the expressions (5) and (6):

$$X_1\Delta\alpha + l_c\Delta\beta + l_d\Delta\gamma = R\Delta\phi\cdot\cos(\phi_1+0.5\Delta\phi) \quad (7).$$

Furthermore, since the following expressions hold:

$$\phi_1 + w_1 = \alpha_1+\beta_1+\gamma_1-\pi/2 \quad (8).$$

and $$\phi_1+\Delta\phi+w_2 = \alpha_1+\beta_1\gamma_1+\Delta\alpha+\Delta\beta+\gamma-\pi/2 \quad (9).$$

the following expression holds from the expressions (8) and (9):

$$w_2 - w_1 = \Delta\alpha + \Delta\beta + \Delta\gamma - \Delta\phi \quad (10).$$

Since all the parameters except $\Delta\alpha$, $\Delta\beta$ and $\Delta\gamma$ in the above-described expressions (4), (7) and (10) are specified, it is possible to obtain the angles $\Delta\alpha$, $\Delta\beta$ and $\Delta\gamma$ of rotation for the respective working machines in order to move the front edge of the bucket from the point $P_1$ to start excavation to the next target point $P_2$ by solving the expressions (4), (7) and (10).

The commands for flow rates for the cylinders of the respective working machines are determined according to the angles $\Delta\alpha$, $\Delta\beta$ and $\Delta\gamma$ of rotation thus obtained. At that time, the commands for flow rates for the respective working machines are determined so that the sum $Q_s(=Q_{bm}+Q_{am}+Q_{bt}$, where $Q_{bm}$; the flow rate for the boom, $Q_{am}$; the flow rate for the arm, and $Q_{bt}$; the flow rate for the bucket) of flow rates of pressurized oil to be supplied to the respective working machines is equal to the discharge flow rate of the pump at that moment. That is, the distribution ratio of flow rates needed for the respective working machines is determined according to the angles $\Delta\alpha$, $\Delta\beta$ and $\Delta\gamma$ of rotation, and the flow rate $Q_d$ of the pump at the maximum output is obtained from the relationship of constant horsepower between the flow rate Q of the pump and the pump pressure P and the actual pump pressure $P_d$ at the present moment. The values of the commands for flow rates for the respective working machines are determined by distributing the flow rate $Q_d$ of the pump in the determined distribution ratio. At that time, the actual flow rates to be supplied to the respective working machines are obtained according to the angle of the boom, the angle of the arm and the angle of the bucket at respective moments, and the above-described distribution ratio is occasionally adjusted according to the calculated actual flow rates so that the boom, arm and bucket can simultaneously reach the target angles $\alpha_2$, $\beta_2$, and $\gamma_2$. The excavation operation for every unit section ends when the arm has reached the target angle $\beta_2$, and the process proceeds to the control for the next section when the angle of the arm has reached the target value $\beta_2$.

Figure 9:
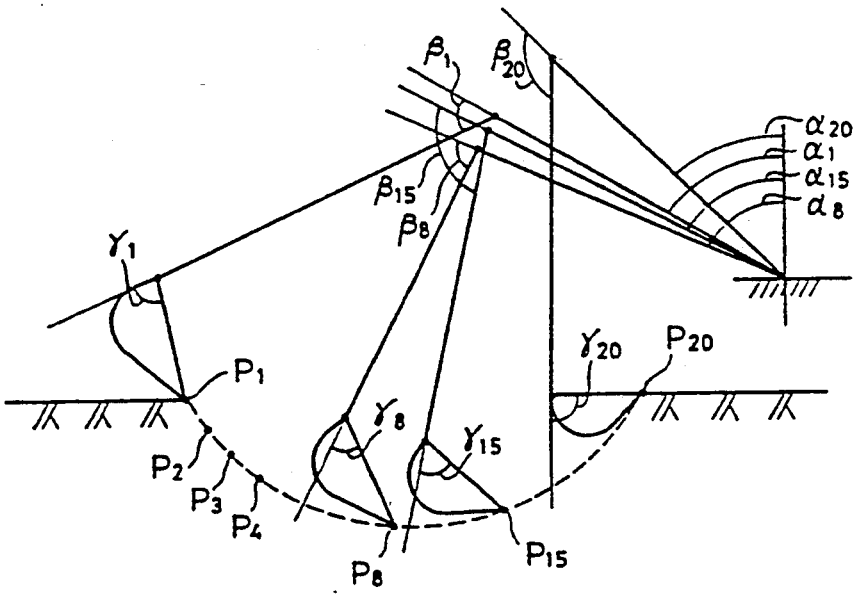
FIG. 9 is a diagram showing an example of the movement of respective working machines at the moment of automatic excavation.

Also in the next section, in the same manner as described above, first, the target position $P_3$ for the front edge of the bucket and the angle $\epsilon_3$ for the posture of the bucket are determined. The angles $\Delta\alpha$, $\Delta\beta$ and $\Delta\gamma$ of rotation are determined according to the above-described determined values, and the commands for flow rates for the respective working machines are determined according to the distribution ratio of flow rates corresponding to the angles $\Delta\alpha$, $\Delta\beta$ and $\Delta\gamma$. The control for this section ends when the arm has reached the target angle $\beta_3$, and the process proceeds to the control for the next section. By repeatedly executing such control operations until the end point $P_n$, the front edge of the bucket moves from the initial point $P_1$ ($\alpha_1$, $\beta_1$, $\gamma_1$) along the target positions $P_8$ ($\alpha_8$, $\beta_8$, $\gamma_8$) - - - $P_{15}$ ($\alpha_{15}$, $\beta_{15}$, $\gamma_{15}$) - - - $P_{20}$ ($\alpha_{20}$, $\beta_{20}$, $\gamma_{20}$) on the circular-arc locus (FIG. 5(*c*)), as shown in FIG. 9.

Figure 10:
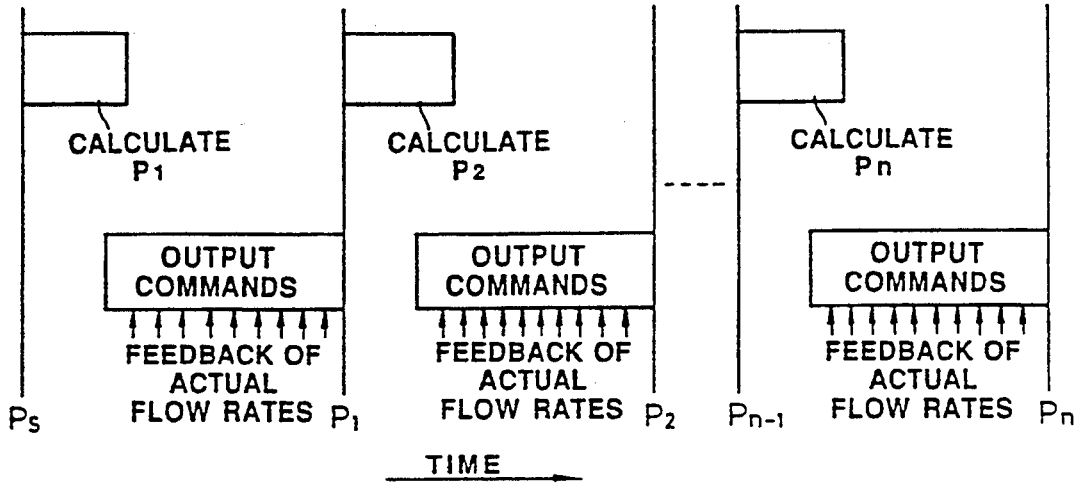
FIG. 10 is a diagram schematically showing the calculation of target positions and output states of a command signal.

FIG. 10 shows the schematic configuration of the above-described arithmetic control. That is, in the present automatic excavation operation, it is intended to reduce the memory capacity by calculating the coordinate position of the next target point at the start of each unit section. Furthermore, the commands for flow rates for the respective working machines are occasionally corrected by performing feedback of actual values of flow rates to the commands for flow rates obtained from these target positions with a proper period, and the front edge of the bucket can thus exactly move on the excavation locus which has been set having proper postures.

When the operation pedal 10 is returned in the course of excavation, the commands for flow rates for the respective working machines are set to zero, and the respective working machines are immediately stopped as long as manual operation is not performed by the operation levers 11 and 12.

Figure 11:
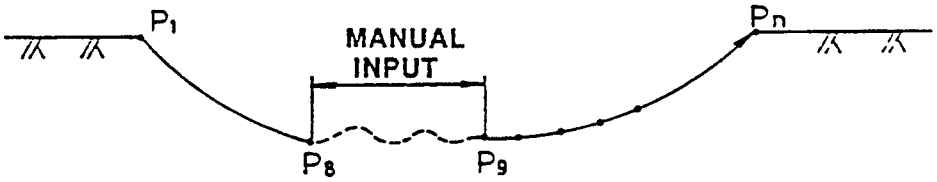
FIG. 11 is a diagram showing a state of excavation when a manual command has been input during excavation.

When commands by the manual levers 11 and 12 have been input during automatic excavation, priority is given to manual operations for the purpose of security, and automatic excavation is resumed from the point where the lever operation has been stopped. For example, if there has been an input of a manual operation when automatic excavation proceeded to the point $P_8$, as shown in FIG. 11, automatic excavation toward the next target point $P_9$ is resumed making the point where the lever operation has been stopped a point to resume excavation. That is, when there has been a manual input during automatic excavation, the automatic excavation is not released, but is temporarily stopped.

In this case, it is arranged so that the end of excavation is detected according to the value of the pump pressure of the hydraulic pump, and that the moment when the pump pressure of the hydraulic pump exceeds a predetermined value in the second half of excavation operations in which excavation sections have proceeded to a certain degree is recognized as a moment to end excavation. After the recognition, the boom is raised, the bucket is tilted to a horizontal state, and the excavation operation is thus terminated. As described above, since the end of excavation is detected by detecting load by the pump pressure of the hydraulic pump, it is possible to prevent wasteful excavation.

Figure 8:
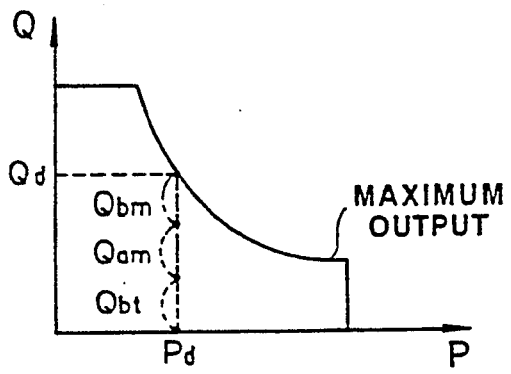
FIG. 8 is a diagram showing a curve of constant horsepower.

After the end of excavation, the tilt angle of the bucket is shifted to a mode for horizontally holding the bucket in which the tilt angle of the bucket is always maintained at a horizontal state (FIG. 8(*d*)). That is, in the mode for horizontally holding the bucket, the angle $\gamma$ of the bucket is automatically controlled so that the relationship $\alpha+\beta+\gamma=(3/2)\pi$ is satisfied in accordance with input commands from the operation lever for the boom and the operation lever for the arm in order to always horizontally maintain the upper surface of the bucket. In the mode for horizontally holding the bucket, the operation of the above-described operation pedal for automatic excavation is made invalid. By such a control operation, it is arranged so that load is not dropped, and the operation during loading work becomes simple (the bucket operation becomes unnecessary).

The automatic excavation mode is released when the bucket is rotated to the dump side by a predetermined amount or more by a manual operation in the mode for horizontally holding the bucket. That is, when the operator rotates the bucket to the dump side by the predetermined amount or more for discharging earth in the mode for horizontally holding the bucket, the automatic excavation mode is released (FIG. 5(*e*)).

Figure 12:
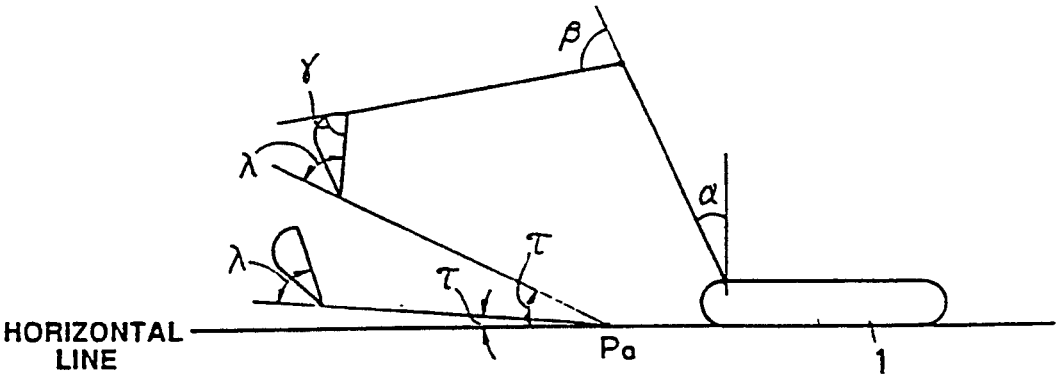
FIG. 12 is a diagram for explaining an initial setting mode for the posture of a bucket.

When the automatic excavation mode has been released, the control shifts to a bucket posture automatic setting mode in which the bucket is always controlled in the most suitable posture at the moment to start excavation (FIG. 5(*f*)). That is, in the bucket posture automatic setting mode, the bucket cylinder is controlled so that the most suitable bucket posture at the moment to start excavation is maintained in accordance with the position of a bucket pin (the point C in FIG. 3) which is determined by the positions of the boom and the arm after discharging earth. To put it concretely, if the bucket posture is defined by the angle $\lambda$ (the angle made by a line segment connecting the position of the front edge of the bucket to the above-described set point $P_2$ and the upper surface of the bucket), as shown in FIG. 12, and the angle made by the horizontal line and the above-described line segment is represented by $\tau$, the angle $\gamma$ of the bucket is controlled so that the following expression is satisfied:

$$\alpha+\beta+\gamma+\lambda+\tau=(3/2)\pi \quad (11).$$

That is, in the above-described expression, the angle $\lambda$ is a predetermined value, and the angle $\tau$ can be obtained from the angles $\alpha$, $\beta$ and the like. Hence, the angle $\gamma$ of the bucket is controlled so that the expression (11) is satisfied in accordance with the angle $\alpha$ of the boom and the angle $\beta$ of the arm provided by manual operations. The bucket posture setting mode is stopped when the operation lever 11 for the bucket is manually operated. Subsequently, the respective working machines including the bucket are driven in accordance with commands from the operation levers 11 and 12.

In the case when the operator has arbitrarily changed the posture of the bucket at the moment of initial automatic excavation or the bucket posture setting mode, and the like, the bucket is not necessarily maintained in the most suitable posture at the moment to start excavation. In such cases, the bucket posture is not abruptly corrected to the most suitable posture until the next section, but sections are provided in an appropriate number, and the bucket is gradually corrected to the most suitable angle in these sections.

Figure 1:
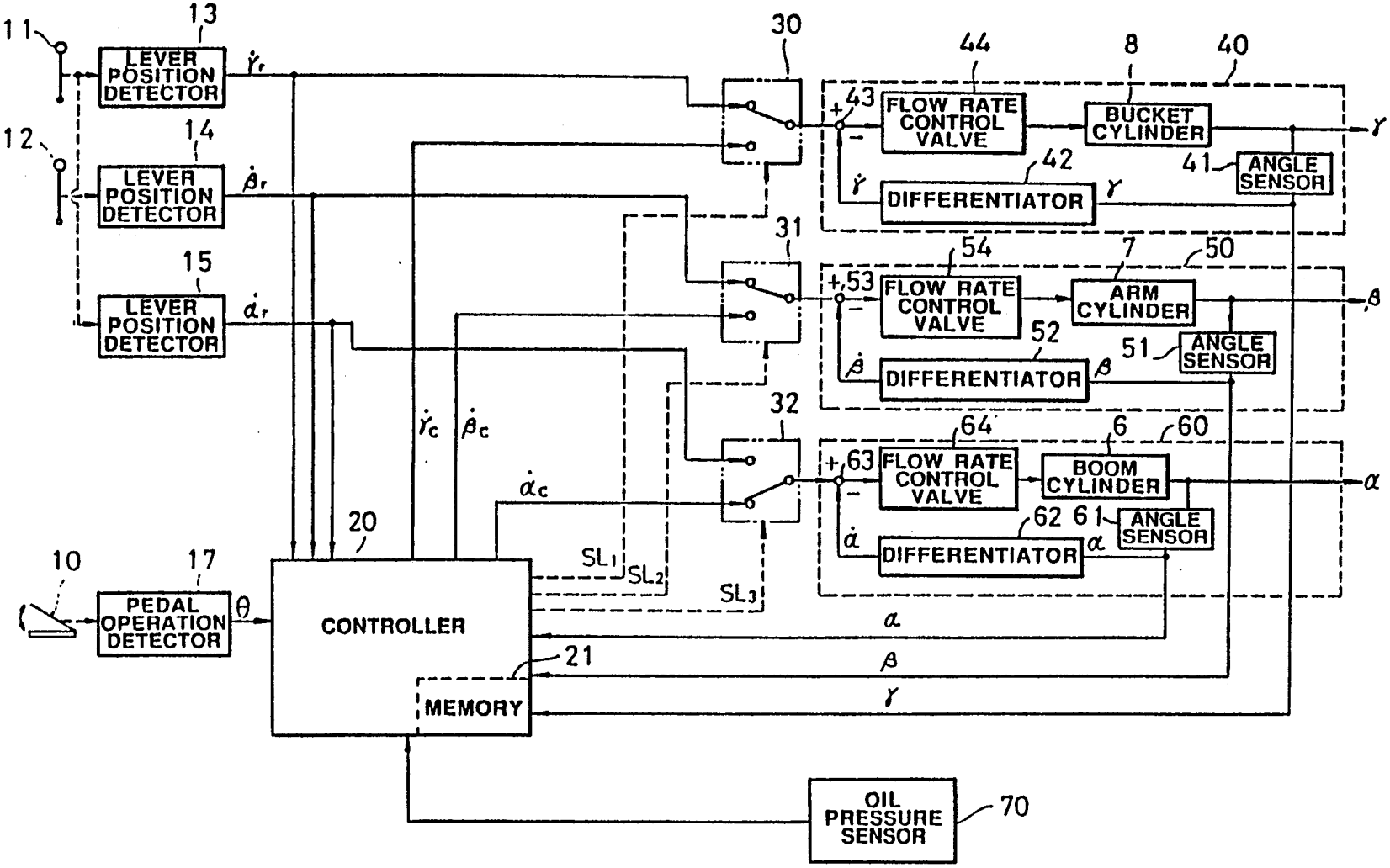
FIG. 1 is a block diagram showing a first embodiment of the present invention.

FIG. 1 shows an example of the configuration of the control for realizing the above-described respective functions. In FIG. 1, whether or not an automatic excavation mode assigning pedal 10 has been trodden is detected by a pedal operation detector 17, and the detected signal is input to a controller 20. The direction and amount of operation of the bucket/boom operation lever 11 are detected by a lever position detectors 13 and 15. A bucket rotation command $\gamma_r$ and a boom rotation command $\alpha_r$ are input from these detectors 13 and 15 to switches 30 and 32, respectively. The direction and amount of the operation of the arm operation lever 12 are detected by a lever position detector 14, and an arm rotation command $\beta_r$ which is the detected signal thereby is input to a switch 31. The command signals $\alpha_r$, $\beta_r$ and $\gamma_r$ by the operation levers 11 and 12 are also input to the controller 20.

The switches 30, 31 and 32 performs switching operations according to switching control signals $SL_1$, $SL_2$ and $SL_3$ input from the controller 20, respectively, and selectively switch command signals $\gamma_c$, $\beta_c$ and $\alpha_c$ at the moment of automatic excavation input from the controller 20 and command signals $\gamma_r$, $\beta_r$ and $\alpha_r$ at the moment of manual excavation input from the lever position detectors 13, 14 and 15.

A bucket control system 40 consists of an angle sensor 41 for detecting the angle $\gamma$ of the bucket, a differentiator 42 for detecting the actual rotation speed $\gamma$ of the bucket by differentiating the angle $\gamma$ of the bucket, an addition point 43 for obtaining a deviation between a target value and a signal indicating the actual rotation speed $\gamma$ of the bucket, and a flow rate control valve 44 for supplying a bucket cylinder 4 with pressurized oil having a flow rate in accordance with a deviation signal from the addition point 43 so as to make the deviation signal 0.

Similarly to the bucket control system 40, an arm control system 50 and a boom control system 60 includes angle sensors 51 and 61, differentiators 52 and 62, addition points 53 and 63, and flow rate control valves 54 and 64, respectively, and control the rotation of the arm and boom so as to coincide with command values.

The angle $\gamma$ of the bucket, the angle $\beta$ of the arm and the angle $\alpha$ of the boom detected by the angle sensors 41, 51 and 61 in these fow rate control systems, respectively, are also input to the controller 20. The pump pressure in a pump (not shown) for the working machines is detected by an oil pressure sensor 70, and the value of the detected pressure is input to the controller 20.

Figure 13:
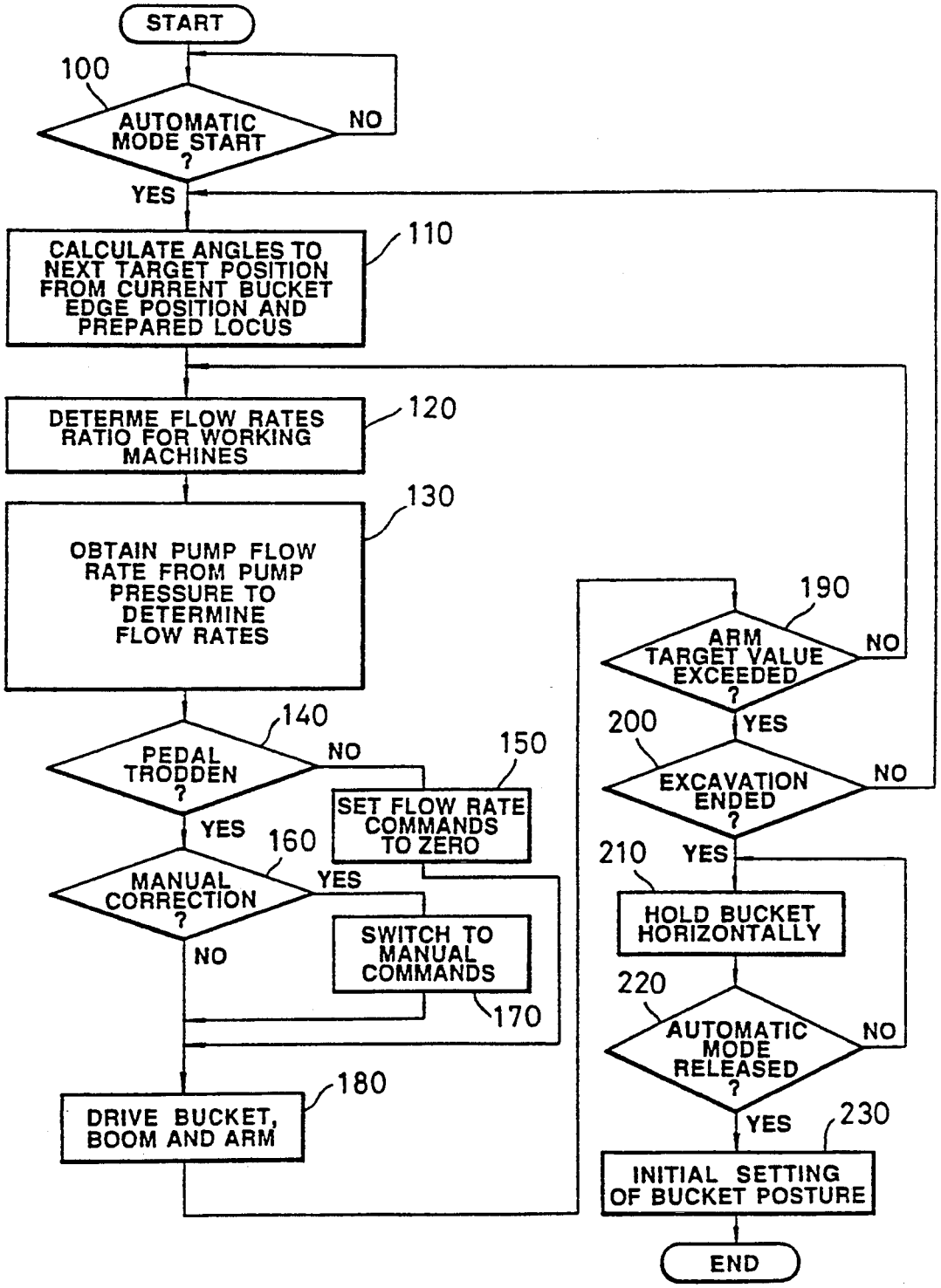
FIG. 13 is a flowchart for explaining the operation of a controller in the first embodiment.

The function of such a configuration will be explained with reference to the flowchart shown in FIG. 13. When the operation pedal 10 has been trodden, the tread is detected by a pedal operation detector 17. The detected signal is input to the controller 20, which starts the control by the automatic excavation mode (step 100). For the purpose of security, it is arranged so that the automatic mode can be operated only when manual operations by the operation levers 11 and 12 are performed and at the moment of the bucket posture automatic setting mode shown in FIG. 5(*f*), and the controller 20 does not start the automatic mode even if the operation pedal 10 has been trodden in other cases.

When the automatic mode has been started, the controller 20 obtains the position $P_1$ of the front edge of the bucket at the moment of start according to the outputs $\gamma$, $\beta$ and $\alpha$ from the angle sensors 41, 51 and 61 (see expression (1)). Subsequently, the controller 20 puts the calculated position $P_1$ to start excavation into an arithmetic program made from the expressions (4), (7) and (10), and calculates angles $\Delta\alpha$, $\Delta\beta$ and $\Delta\gamma$ of rotation for the respective working machines needed to set the bucket to the posture $\epsilon_2$ of the bucket at the next target position $P_2$ and to move the front edge of the bucket from the position $P_1$ to the position $P_2$ (step 110). The controller 20 then determines the distribution ratio of oil to be supplied to the respective working machines from these angles $\Delta\alpha$, $\Delta\beta$ and $\Delta\gamma$ of rotation (step 120), further obtains the pump pressure $P_d$ from the output of the oil pressure sensor 70 at this moment, and obtains the flow rate $Q_d$ of the pump at the maximum output corresponding to the pump pressure $P_d$ from the relationship of constant horsepower shown in FIG. 8. The controller 20 then obtains the command signals $\alpha_c$, $\beta_c$ and $\gamma_c$ for the respective working machines by distributing the flow rate $Q_d$ of the pump in the above-described distribution ratio, and outputs the command signals $\alpha_c$, $\beta_c$ and $\gamma_c$ to the switches 32, 31 and 30, respectively (step 130). When the automatic mode has been selected, respective contacts of the switches 30, 31 and 32 are switched to the side of the controller 20 by the switching control signals $SL_1$, $SL_2$ and $SL_3$ of the controller 20, and the above-described command signals $\alpha_c$, $\beta_c$ and $\gamma_c$ from the controller 20 are input to the boom control system 60, the arm control system 50 and the bucket control system 40 via the switches 32, 31 and 30, respectively.

At the next step 140, the controller 20 determines whether or not the pedal 10 is trodden according to the output from the pedal operation detector 17. When the return of the pedal 10 has been detected, the command signals $\alpha_c$, $\beta_c$ and $\gamma_c$ to be input to the respective flow rate control systems are immediately made zero (step 150). At step 160, it is determined whether or not one of manual commands $\gamma_r$, $\beta_r$ and $\alpha_r$ has been input by the operation of the operation levers 11 and 12. When one of the manual commands has been input, priority is given to the input manual command (step 170). That is, when one of the manual commands have been input, the switch of the working machine corresponding to the input manual command among the switches 30, 31 and 32 is switched to the side of the operation lever, so that the command signal from the side of the operation lever is supplied to the corresponding flow rate control system.

Thus, the command signal $\alpha_c$, $\beta_c$ or $\gamma_c$ (these signals are zero when the operation pedal is switched off) from the controller 20 or the command signals $\alpha_r$, $\beta_r$ or $\gamma_r$ from the manual levers 11 and 12 are input to the corresponding flow rate control systems 60, 40 and 50 in accordance with the operation state of the operation pedal 10 and the operation levers 11 and 12, and the bucket, arm or boom are thereby rotated (step 180). It is arranged so that the controller 20 obtains the actual flow rates of oil to be supplied to the respective cylinders 8, 7 and 6 according to the outputs from the angle sensors 41, 51 and 61, respectively, and successively adjusts the above-described distribution ratio in accordance with these actual flow rates.

Subsequently, the controller 20 determines whether or not the arm has reached the target angle $\beta_2$ according to the detected output $\beta$ from the angle sensor 51 (step 190). When the arm has not reached the target angle $\beta_2$, the process returns to step 120, where the same control as described above is repeated. When the arm has reached the target angle $\beta_2$, it is determined whether or not excavation has ended (step 200). When excavation has not ended, the process returns to step 110, where the arithmetic control to move the position step 110, where the arithmetic control to move the position of the front edge of the bucket to the next target position $P_3$ is performed in the same manner as described above. Subsequently, the front edge of the bucket is moved along the target positions $P_4$, $P_5$, - - - until it is determined that excavation has ended at step 200, in the same manner as described above. In this case, it is arranged so that the moment when the output value from the oil pressure sensor 70 has exceeded a predetermined value in the second half of the excavation sections is detected as the moment to terminate excavation. When a manual command has been input during automatic excavation, the controller 20 returns the process to step 110 at the moment when the manual command has been stopped, switches the switch corresponding to the working machine for which the manual command has been input to the side of the controller 20, and redrives all the working machines by command signals from the controller 20 making the point where the manual operation has been stopped a point to resume the process.

When the end of excavation has been determined at step 200, the controller 20 shifts to the mode for horizontally holding the bucket which horizontally controls the tilt angle of the bucket (step 210). In the mode for horizontally holding the bucket, the switches 31 and 32 are switched to the side of the manual levers 11 and 12, the switch 30 continues to be connected to the side of the controller 20, and the boom and arm are driven according to manual commands. As for the bucket, the command signal $\gamma_c$ is output from the controller 20 so that the relationship $\alpha+\beta+\gamma=(3/2)\pi$ is satisfied, and the tilt angle of the bucket is always maintained in a horizontal state even if the boom and arm are arbitrarily subjected to manual operations. If the bucket has been rotated toward the dump side by a predetermined angle or more during the mode for horizontally holding the bucket, the controller 20 releases the automatic mode (step 220), and shifts the process to a bucket posture initial setting mode (step 230). In this mode, initially, the switches 31 and 32 are connected to the side of the manual levers 11 and 12 and the switch 30 is connected to the side of the controller 20, so that manual commands are input to respective control systems only for the boom and arm. As for the bucket, the command signal $\gamma_c$ from the controller 20 is output so that the above-described expression (11) is satisfied, and hence the bucket always has the most suitable initial posture in accordance with the height of the bucket. This automatic setting mode is stopped when a manual command for the bucket has been input.

Figure 14:
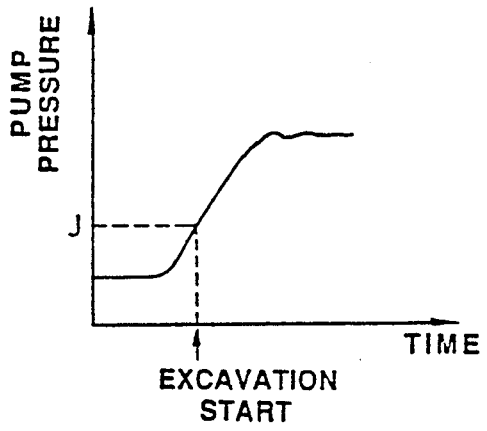
FIG. 14 is a diagram showing the relationship between the pump pressure and the set value for determining the moment to start excavation.

In the above-described embodiment, the moment when the pump pressure exceeds a predetermined set value in the second half of excavation operations, that is, when the load on the working machines exceeds a constant value is made the end of excavation, and the process is then shifted to the mode for horizontally holding the bucket. However, the number of divided sections may merely be counted, and the moment when excavation for a predetermined number of sections has ended may be made the end of excavation. Furthermore, the absolute posture of the bucket may be determined, and the moment when the absolute posture of the bucket nearly approaches a horizontal state may be made the end of excavation Moreover, although, in the above-described embodiment, the moment when the operation pedal 10 has been trodden is made the moment to start excavation and the position of the front edge of the bucket at that moment is made the position to start excavation, the load may be detected according to the pump pressure and the moment when the pump pressure has exceeded a predetermined set value J may be made the moment to start automatic excavation, as shown in FIG. 14, in order to more exactly set the point to start excavation. That is, in the case in which the moment when the operation pedal 10 has been trodden is made the start of excavation, it is difficult to make the moment when the front edge of the bucket has reached earth completely coincide with the moment when the operation pedal has been trodden, and variations therefore arise in the position to start excavation. This causes variations in the amount of excavated earth, which may further cause inferior excavation efficiency. Accordingly, if the condition for determining the moment to start excavation is set to the moment when the pump pressure after the operation pedal has been trodden reaches the set value J or more, it becomes possible to more exactly determine the point to start excavation. That is, if it is assumed that the front edge of the bucket is separated from earth at the moment when the operation pedal has been trodden, the respective working machines are automatically moved in the direction of reaching earth from the moment when the operation pedal has been trodden to the moment when the bucket reaches earth even if the manual operation is stopped. Subsequently, since there is a change in load at the moment when the bucket has reached earth, the change is detected by the pump pressure. To put it concretely, the set point J for detecting the moment to start excavation is set for the pump pressure, the moment when the pump pressure has exceeded the set point J is made the actual moment to start excavation, and the position of the front edge of the bucket is made the position to start excavation. In this case, if the separate pumps are provided for the respective working machines, the moment to start excavation may be detected by the pump pressure of a working machine having a large detection value. In this detection method, since the load detection is performed by the pump pressure, the method has the advantage that only one pressure gauge is needed in the case of using one pump.

Furthermore, the following function to prevent wasteful excavation may be added to the above-described embodiment. As described above, in the present apparatus, automatic excavation is performed so that the excavation angle $\delta$ always becomes small. In such an excavation operation, if it is assumed that conditions, such as the quality of earth and the like, are identical, the amount of work necessary for scooping and pushing aside the same amount of earth is constant. In addition, in the present apparatus, since the control of the pump is performed along the curve of constant horsepower shown in FIG. 8, it is estimated that the time necessary to perform the above-described amount of work can be nearly constant. Accordingly, one automatic excavation operation is first tried at a location having a horizontal surface of earth, and the excavation time at that moment, that is, the time from the moment when the bucket touches the surface of earth to the moment to start scooping (the boom is raised and the bucket is tilted) is measured and stored. For automatic excavation from the next excavation operation, scooping is started from the moment when the stored time has lapsed from the moment to start excavation. Wasteful excavation is thus prevented. In order to perform the above-described timing and storing operations, an appropriate operation button may, for example, be provided, and the measuring and storing operation for the excavation time may be performed when this button has been pushed before the assignment to start automatic excavation by the operation pedal 10. If such a function is supplemented, it is possible to securely prevent wasteful excavation and to shorten the excavation time even if topography has changed due to a change in the number of excavation operations, the locus of excavation and the like.

Next, an explanation will be provided of a second embodiment in which the following additional functions are provided for the operation pedal 10.

(1) The automatic mode is selected and the moment to start excavation is indicated by treading the operation pedal 10 (this function is also provided in the preceding embodiment).

(2) The speeds of the respective working machines can be changed in accordance with the tread angle.

(3) Automatic excavation is terminated by treading the pedal 10 by a predetermined angle or more during automatic excavation.

(4) At the moment of discharging earth (at the moment of releasing the automatic mode), the angle of the arm and the angle of the boom at that time are stored by treading the pedal 10 by a predetermined angle or more. At the moment of excavation after the next excavation operation, if the pedal 10 is trodden after the end of excavation, the arm and boom automatically move to positions corresponding to the angle of the arm and the angle of the boom which have been stored as described above while maintaining the bucket in a horizontal state. This is for discharging earth at an identical position.

Figure 15:
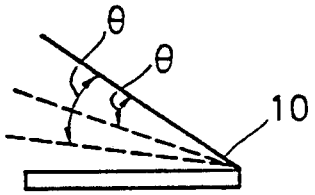
FIG. 15 is a diagram showing an operation pedal in a second embodiment of the present invention.
Figure 16:
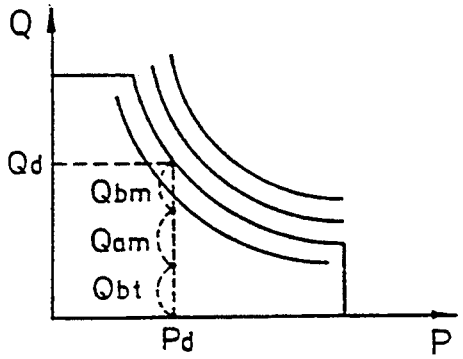
FIG. 16 is a diagram showing curves of constant horsepower.

First, as for the above-described function (2), by changing the sum $Q_s$ ($=Q_{bm}+Q_{am}+Q_{bt}$, where $Q_{bm}$; the flow rate for the boom, $Q_{am}$; the flow rate for the arm, $Q_{bt}$; the flow rate for the bucket) of flow rates of pressurized oil to be supplied to the respective working machines in accordance with the tread angle of the operation pedal 10, the speeds of the working machines are changed in accordance with the tread angle. That is, in the present embodiment, the process is identical to the process in the preceding embodiment in that the angles $\Delta\alpha$, $\Delta\beta$ and $\Delta\gamma$ of rotation for the respective working machines for moving the front edge of the bucket from a certain target point to the next target point are obtained by solving the expressions (4), (7) and (10) described before, and the distribution ratio ($Q_{bm}$:$Q_{am}$:$Q_{bt}$) for flow rates needed for the respective working machines is determined according to the obtained angles $\Delta\alpha$, $\Delta\beta$ and $\Delta\gamma$. At that time, however, the tread angle $\theta$ of the operation pedal 10 is detected (see FIG. 15), and a suitable curve of constant horsepower in accordance with the detected value $\theta$ is selected (see FIG. 16). In this case, as shown in FIG. 16, a plurality of curves of constant horsepower consisting of the relationship between the flow rate Q for the pump and the pump pressure P are set in accordance with the tread angle $\theta$ of the pedal, and a curve of constant horsepower which corresponds to the detected tread angle $\theta$ of the pedal is selected. The values of the commands for flow rates for the respective working machines are determined by obtaining the flow rate $Q_d$ of the pump which corresponds to the actual pump pressure $P_d$ according to the selected curve of constant horsepower, and by distributing the flow rate $Q_d$ of the pump in the determined distribution ratio. That is, in this case, although the total flow rate $Q_s$ is changed in accordance with the tread angle $\theta$ of the pedal, the distribution ratio determined as described above is never changed.

Figure 17:
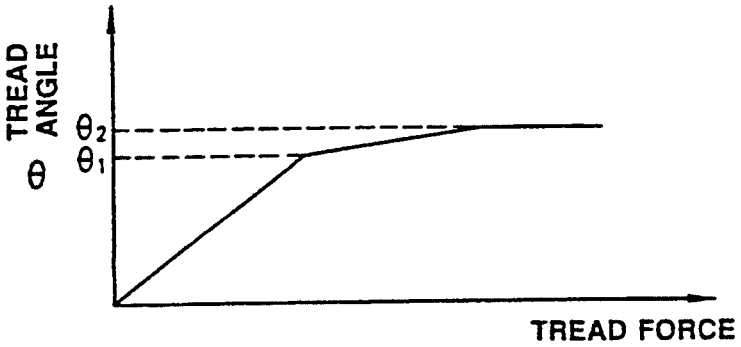
FIG. 17 is a diagram showing the relationship between the tread force and tread angle of an operation pedal.

Next, the above-described function (3) will be explained. When the operation pedal 10 has been trodden by a predetermined angle or more during excavation, scooping (in which the bucket is rotated toward the tilt side and the boom is raised) is performed and automatic excavation is forcibly terminated, even if the excavation section has not been completed to the end, in order to prevent wasteful excavation. That is, the relationship between the tread force and the tread angle $\theta$ of the operation pedal 10 is provided in two stages, as shown in FIG. 17. The operator strongly treads the pedal 10 by the angle $\theta_1$ or more in the case when he determines that the bucket sufficiently scoops earth and sand during excavation, and the like. When the pedal 10 has been trodden by the angle $\theta_1$ or more during excavation, tilting of the bucket and raising of the boom are performed from that moment, and automatic excavation is forcibly terminated. Hence, it is possible to favorably prevent wasteful excavation by the determination of the operator.

Next, the above-described function (4) will be explained.

If the operation pedal 10 has been trodden by the predetermined angle $\theta$ or more in the same manner as described above (see FIG. 17) when the automatic mode explained with reference to FIG. 5(*e*) is released, the angle $\alpha_m$ of the boom and the angle $\beta_m$ of the arm are stored in a memory 21 within the controller 20. At the moment of excavation after the next excavation operation, when the operation terminating pedal is trodden within the angle range of $0-\theta_1$ after automatic excavation, the boom and arm automatically move to positions corresponding to the angle $\alpha_m$ of the boom and the angle $\beta_m$ of the arm which have been stored as described above while maintaining a horizontal state of the bucket at the moment of the mode for horizontally holding the bucket. Thus, earth and sand are discharged at an identical position at the moment of respective excavation operations. During this control operation, if manual commands have been input for the boom and arm, the automatic operations for the boom and arm are stopped, and the boom and arm are thereafter driven in accordance with the manual commands. The bucket is thereafter automatically driven so that the upper surface of the bucket is always maintained in a horizontal state in accordance with the manual commands for the boom and arm.

Thus, in the second embodiment, since the operation pedal 10 is provided with the above-described four functions, it is arranged so that the pedal operation detector 17 shown in FIG. 1 detects the tread angle $\theta$ of the operation detector 17 shown in FIG. 1 detects the tread angle $\theta$ of the operation pedal 10, and the detected signal $\theta$ is input to the controller 20. If the operation pedal 10 has been trodden by the angle $\theta$ or more when the automatic mode was released, the angle $\alpha_m$ of the boom and the angle $\beta_m$ of the arm at that moment are stored in the memory 21 within the controller 20.

Figure 18:
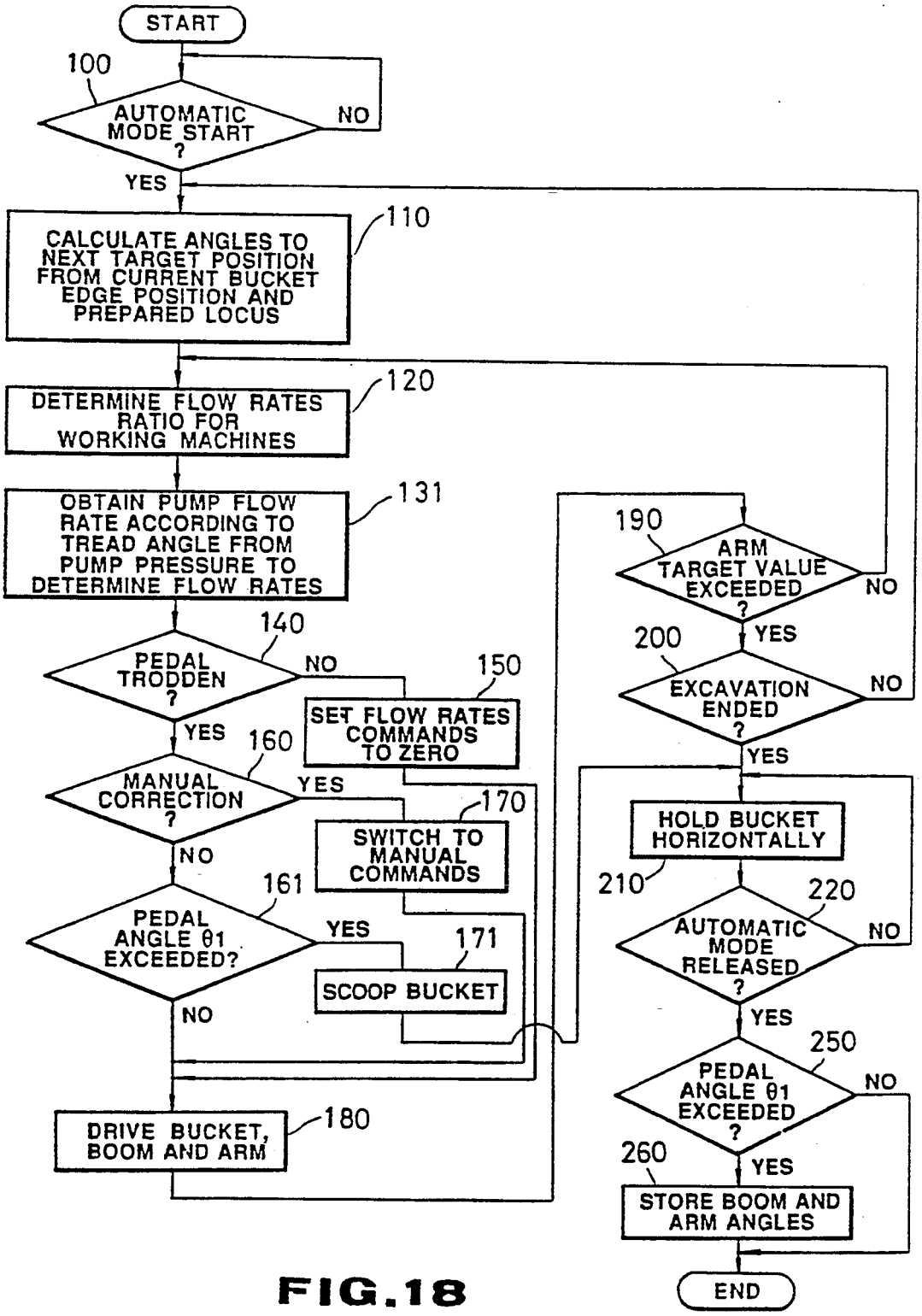
FIG. 18 is a flowchart for explaining the operation of a controller in the second embodiment of the present invention.

FIG. 18 shows such a concrete example of the operation of the second embodiment. In FIG. 18, steps 161, 171, 250 and 260 are added to the flowchart shown in FIG. 13, and step 130 shown in FIG. 13 is replaced by step 131. In FIG. 18, like steps as those shown in FIG. 13 are indicated by like step numbers, and an explanation thereof will be omitted.

That is, at step 131, the controller 20 takes in the detected value $\theta$ by the pedal operation detector 17, selects a curve of constant horsepower corresponding to the detected value $\theta$, obtains the pump pressure $P_d$ from the output from the oil pressure sensor 70 at this moment, and obtains the flow rate $Q_d$ of the pump which corresponds to the pump pressure $P_d$ from the selected curve of constant horsepower. The controller 20 then obtains the command signals $\alpha_c$, $\beta_c$ and $\gamma_c$ for the respective working machines by distributing the pump pressure $Q_d$ in the distribution ratio described before, and outputs the command signals $\alpha_c$, $\beta_c$ and $\gamma_c$ to the switches 32, 31 and 30, respectively.

At step 180, it is determined whether or not the operation pedal 10 has been trodden to an angle exceeding the angle $\theta_1$. If the result is affirmative, excavation is terminated by scooping the bucket to a horizontal state and raising the boom (step 190). Subsequently, the bucket is shifted to the mode for horizontally holding the bucket (step 210). Thus, wasteful excavation is prevented.

When releasing the automatic mode (step 220), it is determined whether or not the operation pedal 10 has been trodden to an angle exceeding the angle $\theta_1$ (step 250). If the result is affirmative, the controller 20 takes in the outputs $\beta_m$ and $\alpha_m$ from the angle sensors 51 and 61, and stores the angle $\beta_m$ of the arm and the angle $\alpha_m$ of the boom which have been taken in the arm memory 21 (step 260). At the moment of excavation after the next excavation operation, when the operation pedal 10 has been trodden within the angle range of $0-\theta_1$ after terminating automatic excavation, the boom and arm automatically move to positions corresponding to the angle $\alpha_m$ of the boom and the angle $\beta_m$ of the arm which have been stored as described above while maintaining a horizontal state of the bucket at the moment of the mode for horizontally holding the bucket described before. Thus, earth and sand are discharged at an identical position at the moment of respective excavation operations. During this control operation, if manual commands have been input for the boom and arm, the controller 20 switches the switches 31 and 32 to the side of the operation levers, and the boom and arm are driven in accordance with the manual commands.

Although, in the present embodiment, the tread up to the second step of the operation pedal is detected by detecting that the operation pedal 10 has been trodden deeper than the predetermined angle $\theta_1$, the tread up to the second step may be determined by detecting that the operation pedal has been trodden up to the angle $\theta_2$ shown in FIG. 17.

Furthermore, the method for changing the sum of commands for flow rates for the respective working machines in accordance with the tread angle of the pedal is not limited to that shown in the above-described embodiment, but a predetermined curve of constant horsepower shown in FIG. 8 may be shifted by a calculation in accordance with the tread angle of the pedal. Any method may be used, provided that the sum of the commands for flow rates for the respective working machines is eventually changed while maintaining the distribution ratio.

Next, a third embodiment of the present invention will be explained.

Figure 19:
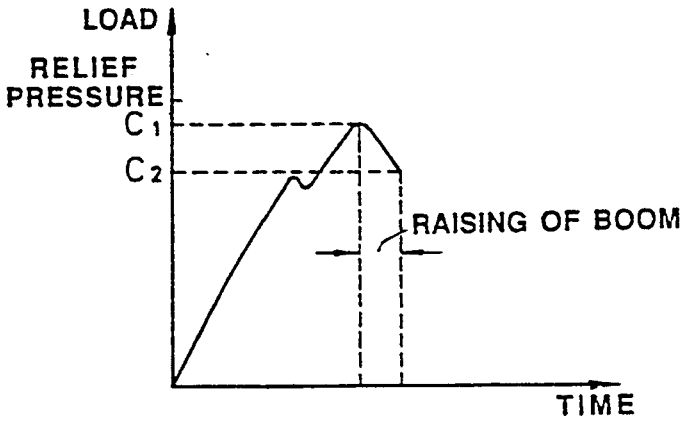
FIG. 19 is a diagram for explaining the relationship between the pump pressure and the set value in a third embodiment of the present invention.
Figure 20:
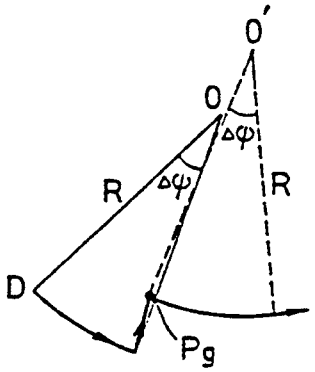
FIG. 20 is a diagram showing variations of the locus when a boom rises in the third embodiment.

In the third embodiment, load detection is performed by detecting the pump pressure of the working machines during automatic excavation as shown in FIGS. 4 and 9, and two different set values $C_1$ and $C_2$ are set for the pump pressure, as shown in FIG. 19. It is arranged so that the set value $C_1$ is a value which is a little smaller than relief pressure, and the set value $C_2$ is a value which is smaller than the value $C_1$ by about several-several tens of kgf/cm$^2$. During automatic excavation, when the above-described pump pressure for the working machines becomes larger than the set value $C_1$, the boom is raised until the pump pressure becomes the set value $C_2$ or less. The raising of the boom is stopped at the moment when the load becomes equal to the set value $C_2$. At the moment of the raising operation of the boom, the arm and bucket are rotated until both the arm and bucket reach the target angles $\Delta\beta$ and $\Delta\gamma$ calculated at the start of the proper excavation section, respectively. Subsequently, the position of the front edge of the bucket for stopping the boom and rotating the bucket and arm to the target angles $\Delta\gamma$ and $\Delta\beta$ as described above is calculated, and automatic excavation for remaining sections is resumed making the calculated position a point to resume excavation. To put it concretely, as shown in FIG. 20, the point to resume excavation after performing the raising of the boom is represented by a symbol $P_g$, the target position is calculated making the point $P_g$ a point to start excavation for the present excavation section. Accordingly, the center of the circular-arc locus moves from point O to point O', and the locus after resuming excavation becomes a locus made by shifting the locus at the moment of the initial excavation operation upwardly by a length corresponding to the raised amount of the boom. Thus, also after resuming excavation, automatic excavation is performed so that a virtual line OD is rotated centering around the point O' successively by a unit angle $\Delta\phi$.

Figure 21:
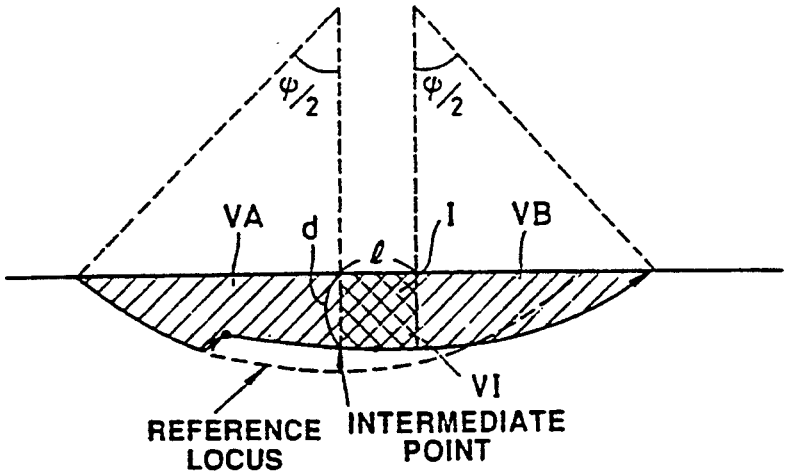
FIG. 21 is a diagram for explaining an example of excavation in which a section for horizontal excavation is provided in the third embodiment.

When the locus is corrected as described above, it is considered that the amount of excavated earth becomes smaller than in the case of not correcting the locus. Hence, in the present embodiment, a horizontal excavation section 1 shown by cross hatching in FIG. 21 is provided so that the amount of excavated earth is always constant.

That is, if it is assumed that excavation sections have proceeded up to an intermediate point after correcting the locus by raising the boom, the volume VA which the front edge of the bucket has cut away up to the present moment and the volume VB which the bucket intends to subsequently cut away when the horizontal excavation section is not provided are calculated. If the excavated volume according to the reference locus when the locus is not corrected is represented by the symbol V and the volume of the horizontal excavation section I is represented by the symbol VI, it is possible to determine the volume VI by the following expression because the volume V can previously be obtained:

$$VI = V - (VA + VB).$$

If the volume VI is thus determined, the depth d of excavation can be obtained from the position of the front edge of the bucket at that moment. Hence, it is possible to obtain the length l=(VI/D) of the horizontal excavation section. By inserting the horizontal excavation section having the calculated length l before the remaining sections, it is arranged so that the amount of excavated earth is always constant.

Figure 22:
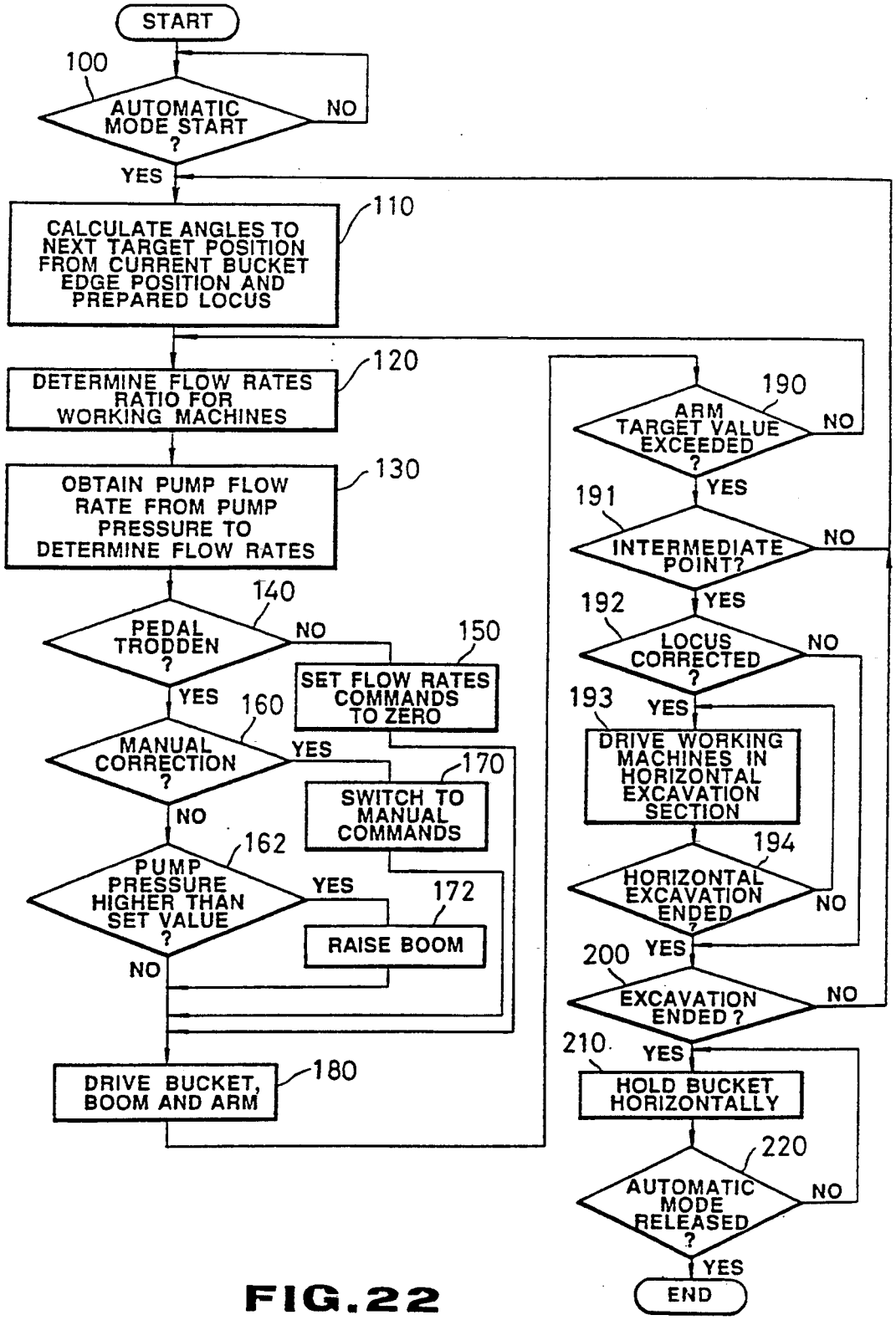
FIG. 22 is a flowchart for explaining the operation of a controller in the third embodiment.

FIG. 22 shows a concrete example of the operation of the third embodiment. This flowchart is made by inserting steps 162 and 172 between step 160 and step 180 in the flowchart shown in FIG. 13 and steps 191–194 between step 190 and step 200. In FIG. 22, like steps having identical functions as those in FIG. 13 are indicated by like step numbers, and an explanation thereof will be omitted.

That is, at step 162 during automatic excavation, the controller 20 determines whether or not the pump pressure detected by the oil pressure sensor 70 has exceeded the set value $C_1$ (step 162). Since the determination seldom becomes "YES" at an initial stage of excavation, the process generally proceeds to step 180.

However, if the pump pressure detected by the oil pressure sensor 70 has exceeded the set value $C_1$ during such automatic excavation operation (step 162), the controller 20 corrects the locus by raising the boom until the pump pressure is reduced down to the set value $C_2$ as shown in FIGS. 19 and 20 (step 172). At the moment of rasing the boom, the arm and bucket are rotated by the angles $\Delta\beta$ and $\Delta\gamma$ of rotation calculated at the start of the excavation section, and the boom is stopped at the moment when the pump pressure is reduced down to the set value $C_2$. Subsequently, automatic excavation is resumed making this point the point to resume excavation.

Subsequently, the controller 20 determines whether or not the arm has reached the target angle $\beta_2$ according to the output $\beta$ detected by the angle sensor 51 (step 190). If the arm has not reached the target angle $\beta_2$, the process returns to step 120. When the arm has reached the target angle $\beta_2$, it is then determined whether or not the excavation has proceeded to an intermediate point (step 191). If the excavation has not proceeded to an intermediate point, the process returns to step 110, where the arithmetic control to move the position of the front edge of the bucket to the next target position is performed in the same manner as described above. Subsequently, in the same manner, the front edge of the bucket is sequentially moved along target positions until it is determined that the excavation has proceeded to an intermediate point at step 191.

When it has been determined that the excavation ended up to an intermediate point (step 191), it is determined whether or not the locus has been corrected (step 192). When the locus has been corrected, the horizontal excavation section which has been explained with reference to FIG. 21 is added, and the working machines are driven by the horizontal excavation (step 193). That is, the controller 20 has stored the positions of the front edge of the bucket calculated from outputs from the angle sensors 41, 51 and 61 at respective moments. Hence, the controller 20 obtains the volume VA cut away by the front edge of the bucket from the start of excavation to the intermediate point according to the stored data, and further obtains the volume VB for the remaining sections from the reference locus of movement which has previously been set and the actual position of the front edge of the bucket. The controller 20 then obtains the volume VI for the horizontal excavation section I by subtracting the added value of the excavation volume VA and VB from the excavation volume V when the locus is not corrected, and determines the length l of the section by dividing the volume VI by the actual depth d of excavation calculated from the outputs from the angle sensors 41, 51 and 61.

When the horizontal excavation has ended (step 194), it is determined whether or not the excavation has ended (step 200). Subsequently, the process returns to the mode for horizontally holding the bucket described before (step 210).

In the present embodiment, when the locus is corrected by raising the boom, the bucket and arm are rotated until both the bucket and arm reach the target angles and the point of the front edge of the bucket at that moment is made a point to resume excavation. However, the position of the front edge of the bucket at the moment when the arm has reached the target angle after raising of the boom was stopped may be made a point to resume excavation. Furthermore, the horizontal excavation is not limited to an indermediate point, but may be performed at an arbitrary excavation point. Moreover, the horizontal excavation may be properly added even when the correction of the locus by raising the boom is not performed.

Next, a fourth embodiment of the present invention will be explained.

Figure 23:
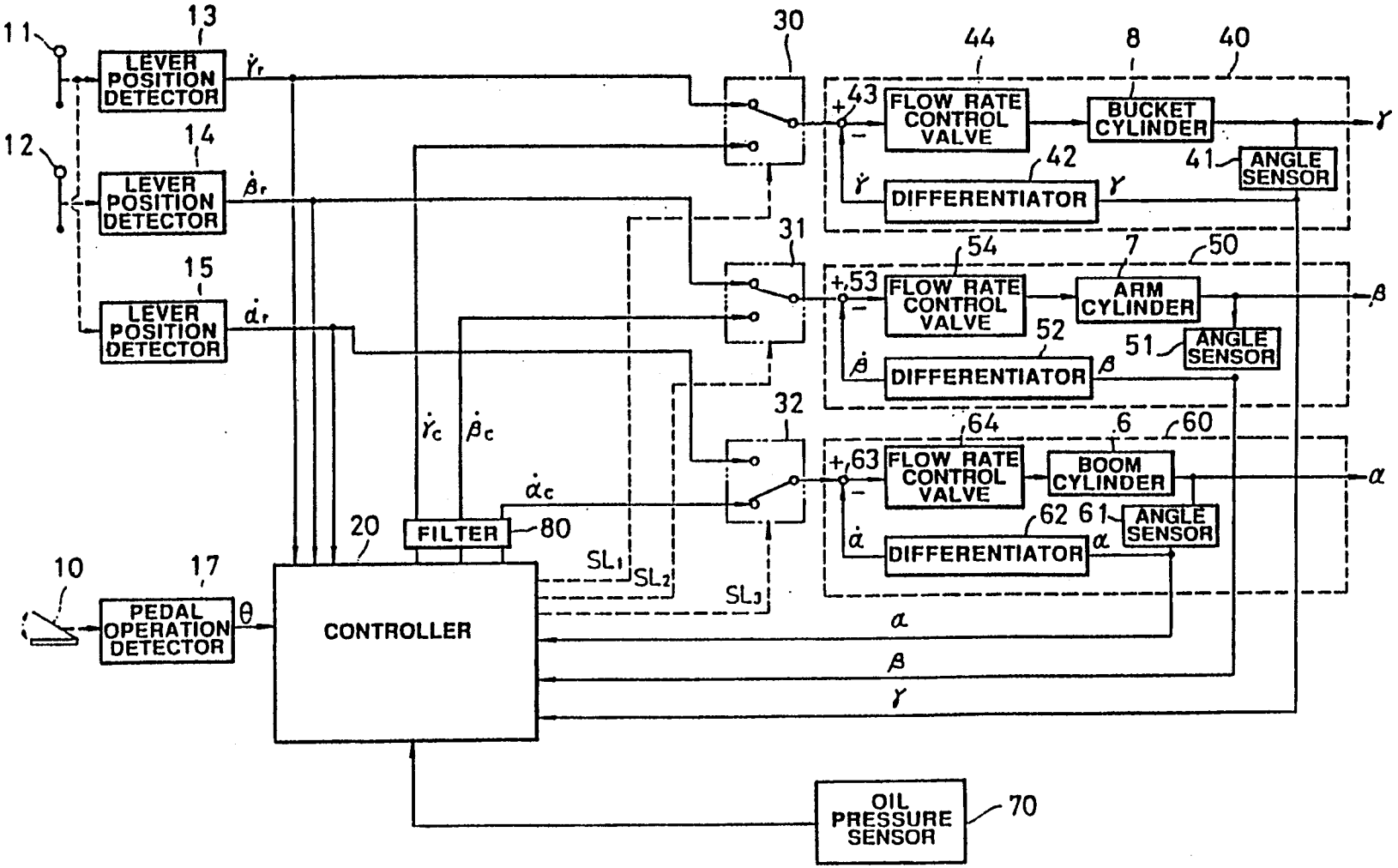
FIG. 23 is a block diagram showing an example of the configuration of control in a fourth embodiment of the present invention.

FIG. 23 shows the configuration of the control according to the fourth embodiment, wherein a filter 80 is added to the configuration of FIG. 1. That is, the respective command signals $\alpha_c$, $\beta_c$ and $\gamma_c$ output from the controller 20 are input to the control systems 60, 50 and 40 via the filter 80, respectively, and hence abrupt variations in the command signals are suppressed by the filter 80.

In the present embodiment, the following control is performed when the commands $Q_{am}$, $Q_{bm}$ and $Q_{bt}$ for flow rates for the respective working machines are determined.

Figure 24:
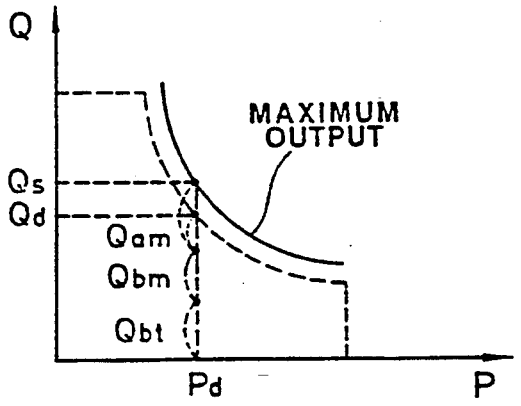
FIG. 24 is a diagram for explaining a method for determining commands for flow rates.

That is, the controller 20 obtains the angles $\Delta\alpha$, $\Delta\beta$ and $\Delta\gamma$ of rotation of the respective working machines for moving the front edge of the bucket from a certain point to start excavation to the next target point according to the expressions (4), (7) and (10) described before, and then determines the distribution ratio of flow rates of pressurized oil needed for the respective working machines according to the obtained angles $\Delta\alpha$, $\Delta\beta$ and $\Delta\gamma$ of rotation. The controller 20 then obtains the flow rate $Q_d$ of the pump at the moment of the maximum output from the relationship between the flow rate Q of the pump and the pump pressure P indicated by a dotted line in FIG. 24 and the actual pump pressure $P_d$ which has been detected. The commands for flow rates for the respective working machines are determined from the flow rate $Q_d$ of the pump thus obtained and the above-described distribution ratio. As for the command $Q_{am}$ for the flow rate for the arm the load of which is considered to be largest, a value which is larger than the value of the command determined from the flow rate $Q_d$ of the pump and the distribution ratio, for example the maximum value, is assigned. As for the commands $Q_{bm}$ and $Q_{bt}$ for the flow rates for the remaining two working machines (the boom and bucket), the values of the commands determined from the flow rate of the pump and the distributaion ratio described above are output. Thus, it is arranged so that the sum $Q_s$ ($=Q_{bm}+Q_{am}+Q_{bt}$, where $Q_{bm}$; the command for the flow rate for the boom, $Q_{am}$; the command for the flow rate for the arm, $Q_{bt}$; the command for the flow rate for the bucket) of the commands for the flow rates for the respective working machines becomes larger than the flow rate $Q_d$ of the pump which has been obtained.

By outputting the commands for flow rates via the filter 80, variations of the values of the commands with time are reduced so that the machine can operate following the values of the commands.

Figure 25:
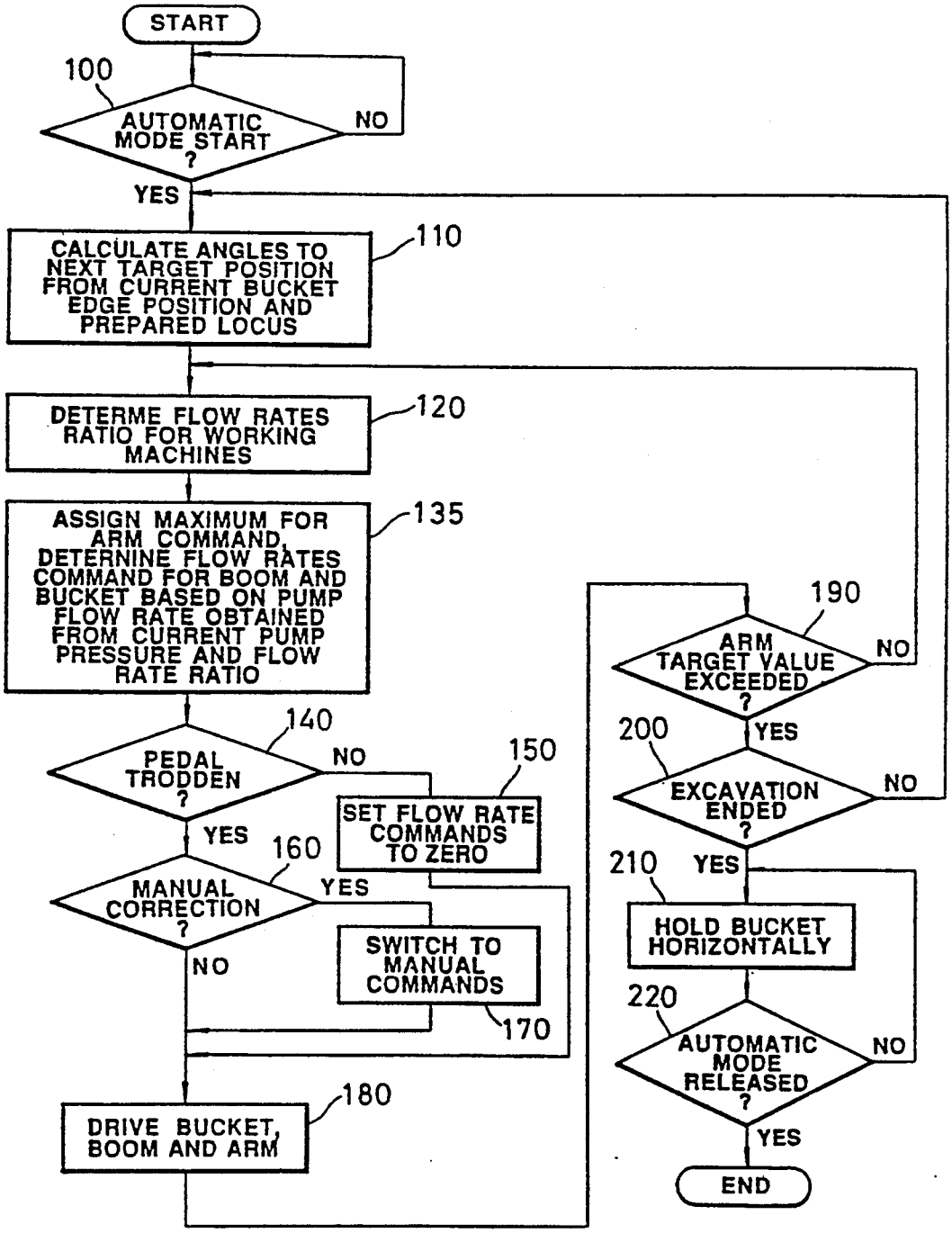
FIG. 25 is a flowchart showing the operation of a controller in the fourth embodiment.

FIG. 25 is a flowchart showing such function of the fourth embodiment. In this flowchart, step 130 in the flowchart shown in FIG. 13 is replaced by step 135.

That is, at step 135, when determining the commands for flow rates for the respective working machines from the obtained flow rate $Q_d$ of the pump and the above-described distribution ratio, the controller 20 assigns a value which is larger than the value of the command determined from the flow rate $Q_d$ of the pump and the distribution ratio, for example the maximum value, for the command $Q_{am}$ for the flow rate for the arm the load of which is considered to be largest. As for the commands $Q_{bm}$ and $Q_{bt}$ for the flow rates for the remaining two working machines (the boom and bucket), the values of the commands which are determined from the flow rate of the pump and the distribution ratio described above are output. Thus, the controller 20 obtains the command signals $\alpha_c$, $\beta_c$ and $\gamma_c$ for the respective working machines, and outputs the command signals $\alpha_c$, $\beta_c$ and $\gamma_c$ to the switches 32, 31 and 30 via the filter 80, respectively.

As described above, in the present embodiment, at the moment of automatic excavation, a value which is larger than the command for the flow rate obtained from the distribution ratio and the pump pressure, for example the maximum value, is assigned for the command for the flow rate for the working machine having large load, and the commands for flow rates obtained from the distribution ratio and the pump pressure are output for the boom and bucket which have small load. Hence, the actual flow rates for the respective working machines are distributed exactly in the calculated distribution ratio, and the sum of the actual flow rates of oil flowing for the respective working machines coincides with the flow rate of the pump at the moment of the maximum output which is obtained from the pump pressure. Accordingly, relief loss and loss in the output of the pump are reduced. As a result, it becomes possible to effectively utilize the output of the pump, and to increase excavation efficiency. Furthermore, since it is arranged so that the commands for flow rates are output via the filter 80, abrupt variations in the values of the commands are suppressed. As a result, it is possible to reduce loss in the output of the pump.

INDUSTRIAL APPLICABILITY

The present invention can be applied to automatic excavation for a power shovel having a boom, an arm and a bucket.

We claim:

1. A controlling device for a power shovel which includes a vehicle body, a boom pivoted to the body, an arm pivoted to the boom, a bucket pivoted to the arm, a boom cylinder for pivoting the boom, an arm cylinder for pivoting the arm, a bucket cylinder for pivoting the bucket, and a hydraulic pump for supplying pressurized oil into said boom cylinder, arm cylinder, and bucket cylinder, said controlling device comprising:

automatic mode assigning means for assigning an automatic mode of excavation;

automatic mode start detection means for detecting a moment to start excavation by the automatic mode;

angle detection means for detecting an angle of the bucket with respect to the arm, an angle of the arm with respect to the boom and an angle of the boom with respect to the body;

pump pressure detection means for detecting the pump pressure of oil supplied by the pump;

first arithmetic means comprising means for receiving values detected by said angle detection means at the moment to start excavation according to an output from said automatic mode start detection means, and means for obtaining the position of a front edge of the relative to the vehicle body at the moment to start excavation according to the detected angle values;

second arithmetic means comprising means for initially setting a reference locus of movement of a front edge of the bucket approximated by a plurality of points, means for initially setting respective postures of the bucket when the front edge of the bucket is situated at the plurality of points, means for calculating a position relative to the vehicle body for each of said plurality of points which have been set position-by-position for each of a plurality of excavation sections divided by said plurality of points according to the position to start excavation obtained by said first arithmetic means, and means for calculating an angle of rotation of the bucket, an angle of rotation of the arm and an angle of rotation of the boom needed to move the front edge of the bucket to said calculated position and to set the bucket to the posture of the bucket which has been set for each respective point for each of the excavation sections;

third arithmetic means comprising means for obtaining a distribution ratio of flow rates of pressurized oil to be supplied to the respective hydraulic cylinders for each of the excavation sections according to the angle of rotation of the bucket, the angle of rotation of the arm and the angle of the boom calculated for each of the excavation sections, and means for calculating and outputting commands for flow rates for the respective hydraulic cylinders according to a flow rate of the pump obtained from the pump pressure and the distribution ratio obtained;

excavation section end detection means comprising means for detecting a moment when the angle of the arm reaches a target arm position for each of the excavation sections according to an output from the angle detection means, and means for incrementing the arithmetic control by the second and third arithmetic means to the arithmetic control for the next excavation section at the moment of the detection;

switching means for outputting respective commands for flow rates output from said third arithmetic means in place of manual commands giving priority to manual commands when the automatic mode has been assigned by the automatic mode assigning means; and automatic excavation end detection means for detecting the end of automatic excavation by said automatic mode.

2. A controlling device for a power shovel according to claim 1, wherein said third arithmetic means sets respective commands for flow rates to be output to zero when the automatic mode by the automatic mode assigning means has been released.

3. A controlling device for a power shovel according to claim 1, wherein said automatic mode start detection means detects the assigned moment by said automatic mode assigning means.

4. A controlling device for a power shovel according to claim 1, wherein said automatic mode start detection means detects a moment when the pump pressure detected by said pressure detection means exceeds a predetermined value.

5. A controlling device for a power shovel according to claim 1, wherein said second arithmetic means rotates the reference locus of movement set in accordance with an angle made by the position to start excavation obtained by said first arithmetic means and a predetermined reference position, calculates positions of a plurality of points on said rotated locus relative to the vehicle, and calculates the angle of rotation of the bucket, the angle of rotation of the arm and the angle of ratio of the boom for each excavation section from the calculated position.

6. A controlling device for a power shovel according to claim 1, wherein said automatic excavation end detection means counts the number of excavation sections completed, and assigns a moment when the counted value becomes a predetermined value to be a moment to end excavation.

7. A controlling device for a power shovel according to claim 1, wherein said automatic excavation end detection means detects a moment when an absolute posture of the bucket becomes nearly horizontal.

8. A controlling device for a power shovel according to claim 1, wherein said automatic excavation end detection means detects a moment when the pump pressure detected by said pressure detection means has exceeded a predetermined value.

9. A controlling device for a power shovel according to claim 1, wherein said automatic excavation end detection means includes a memory for storing excavation time when automatic excavation has been tried, and assigns a moment when the excavation time stored in said memory has lapsed to be a moment to end excavation in the case of automatic excavation after the next excavation operation.

10. A controlling device for a power shovel according to claim 1, wherein said third arithmetic means obtains actual flow rates of pressurized oil according to respective outputs from said angle detection means, and successively corrects the obtained distribution ratio so that the bucket, arm and boom can simultaneously reach target angles for each excavation section according to said actual flow rates obtained.

11. A controlling device for a power shovel according to claim 1, wherein said automatic mode assigning means comprises an operation pedal, said automatic mode start detection means comprises tread angle detection means for detecting a tread angle of said operation pedal and means for outputting an automatic mode start signal in accordance with the detected tread angle and, said third arithmetic means varies the sum of the commands for flow rates for the respective working machines in accordance with a value detected by the tread angle detection means while maintaining the distribution ratio.

12. A controlling device for a power shovel according to claim 11, wherein said operation pedal is configured so that tread force which is larger than the tread force up to a predetermined angle is needed when the tread force angle equals or exceeds the predetermined angle, and wherein said apparatus further comprising forcible stop means for forcibly stopping automatic excavation when the value detected by said tread angle detection means exceeds the predetermined angle during automatic excavation.

13. A controlling device for a power shovel according to claim 1, wherein said automatic mode assigning means comprises an operation pedal, said automatic mode start detection means detects a tread angle of said operation pedal, selects the automatic mode and assigns the excavation start time when the tread angle is less than the predetermined angle, and wherein said apparatus further comprises:

bucket horizontal holding means for executing, when said automatic excavation and detection means has detected the end of automatic excavation, a bucket horizontal mode for automatically driving the bucket to horizontally hold the bucket in accordance with manual commands from operation levers for the arm and boom taking preference of a manual command from an operation lever for the bucket;

storage means for storing the angle of the arm and the angle of the boom at the proper moment when said operation pedal has been depressed by said predetermined angle or more, when the bucket was rotated toward the side of discharged earth by a predetermined amount or more in the horizontal mode for the bucket; and means for automatically moving the boom and arm to positions corresponding to the angle of the boom and the angle of the arm stored in said storage means in a state of horizontally holding the bucket when said operation pedal is depressed in the horizontal mode for the bucket in a later automatic mode.

14. A controlling device for a power shovel according to claim 13, wherein said operation pedal is configured so that tread force which is larger than the tread force up to a predetermined angle is needed when the tread force angle reaches or exceeds the predetermined angle or more.

* * * * *